US011507122B2

(12) United States Patent
Feng et al.

(10) Patent No.: US 11,507,122 B2
(45) Date of Patent: Nov. 22, 2022

(54) DIGITAL VOLTAGE REGULATOR WITH A FIRST VOLTAGE REGULATOR CONTROLLER AND A SECOND VOLTAGE REGULATOR CONTROLLER AND METHOD OF REGULATING VOLTAGE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: Hefei Xinsheng Optoelectronics Technology Co., Ltd., Anhui (CN); Beijing BOE Technology Development Co., Ltd., Beijing (CN)

( * ) Notice: Subject to any disclaimer, the term of this patent is extended or adjusted under 35 U.S.C. 154(b) by 128 days.

(21) Appl. No.: 16/643,109

(22) PCT Filed: Sep. 2, 2019

(86) PCT No.: PCT/CN2019/103982
§ 371 (c)(1),
(2) Date: Feb. 28, 2020

(87) PCT Pub. No.: WO2020/048420
PCT Pub. Date: Mar. 12, 2020

(65) Prior Publication Data

US 2021/0232166 A1 Jul. 29, 2021

(30) Foreign Application Priority Data

Sep. 4, 2018 (CN) ..... 201811026090.6

(51) Int. Cl.
*G05F 1/575* (2006.01)
*G05F 1/46* (2006.01)

(52) U.S. Cl.
CPC ..... *G05F 1/575* (2013.01); *G05F 1/468* (2013.01)

(58) Field of Classification Search
CPC ..... H02M 1/32; H02M 2001/322; H02M 2001/327; H02M 1/34; H02M 2001/342;
(Continued)

(56) References Cited

U.S. PATENT DOCUMENTS 6,262,558 B1 * 7/2001 Weinberg ..... G05F 1/67 320/101
7,728,569 B1 * 6/2010 Le ..... G05F 1/575 323/280
(Continued)

FOREIGN PATENT DOCUMENTS

CN 102623061 A 8/2012
CN 102710130 A 10/2012
(Continued)

OTHER PUBLICATIONS

First Office Action dated Oct. 25, 2019 for application No. CN201811026090.6 with English translation attached.
(Continued)

*Primary Examiner* — Kevin J Comber
*Assistant Examiner* — Nusrat Quddus
(74) *Attorney, Agent, or Firm* — Nath, Goldberg & Meyer; Joshua B. Goldberg

(57) ABSTRACT

There is provided a digital voltage regulator, which includes a first comparator, a circuit switching circuit, a voltage regulation control circuit, a first transistor array and a second transistor array; a width-to-length ratio of any one of transistors in the first transistor array is larger than that of any
(Continued)

one of transistors in the second transistor array; the first comparator outputs a comparison result between a first reference voltage and an output voltage; the voltage regulation control circuit generates a voltage regulating signal according to the comparison result under control of a clock signal; the circuit switching circuit controls one of the first transistor array and the second transistor array according to a comparison result between the output voltage and a second reference voltage and a comparison result between the output voltage and a third reference voltage to regulate the output voltage based on the voltage regulating signal.

18 Claims, 5 Drawing Sheets

(58) Field of Classification Search
CPC ..... H02M 2001/344; H02M 2001/346; H02M 2001/348; H02M 1/36; H02M 1/38; H02M 1/42; H02M 1/4208; H02M 1/4216; H02M 1/4225; H02M 1/4233; H02M 1/4241; H02M 1/425; H02M 1/4258; H02M 1/4266; H02M 2001/4275; H02M 2001/4283; H02M 2001/4291; H02M 5/2573; H02M 1/081; H02M 5/293; H02M 7/12; H02M 3/10; H02M 3/125; H02M 3/13; H02M 3/135; H02M 3/145; H02M 3/15; H02M 3/155; H02M 3/156; H02M 3/158; H02M 3/1588; H02M 2003/1566; H02M 3/1582; H02M 2003/1557; G05F 1/00; G05F 1/10; G05F 1/12; G05F 1/46; G05F 1/455; G05F 1/45; G05F 1/445; G05F 1/66; G05F 1/40; G05F 1/42; G05F 1/44; G05F 1/462; G05F 1/52; G05F 1/56; G05F 3/10; G05F 3/16; G05F 3/18; G05F 3/185; G05F 3/20; G05F 3/26; G05F 3/30; G05F 3/205; G05F 3/22; G05F 3/24; G05F 3/222; G05F 3/242; G05F 3/225; G05F 3/227; G05F 3/245; G05F 3/247; G05F 3/262; G05F 3/265; G05F 3/267; G05F 1/575; H05B 36/048; H05B 2215/069; B23K 11/24
See application file for complete search history.

(56) References Cited

U.S. PATENT DOCUMENTS 8,063,805 B1 * 11/2011 Eid ..... G05F 1/56 341/142
10,063,203 B1 * 8/2018 Harwalkar ..... H03G 3/20
10,108,213 B2 * 10/2018 Yang ..... G05F 1/575
10,164,593 B1 * 12/2018 Harwalkar ..... H02M 1/00
10,203,709 B1 * 2/2019 Feng ..... G05F 1/461
10,216,209 B1 * 2/2019 Ham ..... G05F 1/575
10,425,002 B2 * 9/2019 Yao ..... H03F 3/45
10,818,963 B2 * 10/2020 Makino ..... H01M 4/505
2009/0033298 A1 * 2/2009 Kleveland ..... G05F 1/575 323/271
2011/0187339 A1 * 8/2011 Trattler ..... H05B 45/375 323/283
2014/0002041 A1 1/2014 Soenen et al.
2014/0084881 A1 * 3/2014 Shih ..... G05F 1/56 323/269
2014/0111173 A1 * 4/2014 Lee ..... G05F 1/565 323/281
2014/0266103 A1 * 9/2014 Wang ..... G05F 1/565 323/275
2014/0266143 A1 * 9/2014 Saint-Laurent ..... G05F 1/468 323/353
2014/0277812 A1 * 9/2014 Shih ..... G05F 1/46 700/297
2014/0285165 A1 * 9/2014 Wang ..... G05F 1/575 323/274
2015/0177758 A1 * 6/2015 Kim ..... G05F 1/575 323/280
2016/0336870 A1 * 11/2016 Halim ..... H02M 1/4225
2017/0033689 A1 * 2/2017 Chen ..... H02M 3/158
2017/0163152 A1 * 6/2017 Holzmann ..... H02M 3/157
2017/0192447 A1 * 7/2017 Kimura ..... G05F 3/16
2017/0212540 A1 * 7/2017 Cho ..... H03K 5/1534
2017/0279359 A1 * 9/2017 Goncalves ..... H02M 1/088
2018/0267480 A1 * 9/2018 Mahajan ..... G04F 10/005
2018/0292851 A1 * 10/2018 Mahajan ..... G05F 1/575
2019/0204862 A1 * 7/2019 Feng ..... G05F 1/59
2020/0007117 A1 * 1/2020 Tang ..... H03K 3/037

FOREIGN PATENT DOCUMENTS

CN 104470095 A 3/2015
CN 105308529 A 2/2016
CN 108415502 * 8/2017
CN 107402591 A 11/2017
CN 107977037 A 5/2018
CN 108021175 A 5/2018
CN 108181963 A 6/2018
CN 108227808 A 6/2018
CN 109947163 A 6/2019
KR 101198852 * 11/2012

OTHER PUBLICATIONS

Second Office Action dated Apr. 14, 2020 for application No. CN201811026090.6 with English translation attached.

* cited by examiner

DIGITAL VOLTAGE REGULATOR WITH A FIRST VOLTAGE REGULATOR CONTROLLER AND A SECOND VOLTAGE REGULATOR CONTROLLER AND METHOD OF REGULATING VOLTAGE

CROSS REFERENCE TO RELATED APPLICATIONS

The present application is a U.S. National Stage Application under 35 U.S.C. § 371 of International Patent Application No. PCT/CN2019/103982, filed on Sep. 2, 2019, which claims priority to China Patent Application No. 201811026090.6 filed on Sep. 4, 2018, the disclosure of both which are incorporated by reference herein in entirety.

TECHNICAL FIELD

The present disclosure relates to the technical field of power management device, and more particularly, to a digital voltage regulator and a method of regulating voltage.

BACKGROUND

Low Dropout (LDO) digital voltage regulators, as power management circuits, have been widely used in fields of portable electronic devices, wireless energy transmission systems, or the like. According to a traditional D-LDO digital voltage regulator, an output voltage $V_{out}$ is compared with a reference voltage $V_{ref}$ to obtain a comparison result, the comparison result is output to a counter to control an increase or a decrease of value of the counter, the counter transmits the value thereof to a decoder for decoding, the decoder controls a number of transistors to be turned on in a PMOS transistor array according to a decoded signal so as to regulate the output voltage $V_{out}$, the output voltage $V_{out}$ is fed back to a comparator again to be compared with the reference voltage $V_{ref}$, and finally digital voltage regulation is achieved.

SUMMARY

Embodiments of the present disclosure provide a digital voltage regulator, including a first comparator, a circuit switching circuit, a voltage regulation control circuit, a first transistor array and a second transistor array, where a width-to-length ratio of any one of transistors in the first transistor array is larger than that of any one of transistors in the second transistor array, and the first comparator is configured to output a comparison result between a first reference voltage and an output voltage; the voltage regulation control circuit is configured to generate a voltage regulating signal according to the comparison result output by the first comparator under control of a clock signal; and the circuit switching circuit coupled between the first comparator and the voltage regulation control circuit, and is configured to select one of the first transistor array and the second transistor array according to a comparison result between the output voltage and a second reference voltage and a comparison result between the output voltage an a third reference voltage to regulate the output voltage based on the voltage regulating signal.

In an embodiment, the voltage regulation control circuit includes a first voltage regulation control circuit and a second voltage regulation control circuit, where the first voltage regulation control circuit is coupled between the circuit switching circuit and the first transistor array, and is configured to, in response to that the first voltage regulation control circuit is electrically coupled with the first comparator under control of the circuit switching circuit, generate a first voltage regulating signal, according to a comparison result output by the first comparator, under control of a first clock signal, so as to control a number of transistors to be turned on in the first transistor array; and the second voltage regulation control circuit is coupled between the circuit switching circuit and the second transistor array, and is configured to, in response to that the second voltage regulation control circuit is electrically coupled with the first comparator under control of the circuit switching circuit, generate a second voltage regulating signal, according to the comparison result output by the first comparator, under control of a second clock signal, so as to control a number of transistors to be turned on in the second transistor array.

In an embodiment, the first voltage regulation control circuit includes a first shift register, a first terminal of the first shift register is coupled with the circuit switching circuit, a second terminal of the first shift register is coupled with the first transistor array, and a control terminal of the first shift register is coupled with a first clock signal terminal; and the second voltage regulation control circuit includes a second shift register, a first terminal of the second shift register is coupled with the circuit switching circuit, a second terminal of the second shift register is coupled with the second transistor array, and a control terminal of the second shift register is coupled with a second clock signal terminal.

In an embodiment, the first voltage regulation control circuit includes a first counter and a first decoder, where a first terminal of the first counter is coupled with the circuit switching circuit, a second terminal of the first counter is coupled with a first terminal of the first decoder, a control terminal of the first counter is coupled with a first clock signal terminal, and a second terminal of the first decoder is coupled with the first transistor array; and the second voltage regulation control circuit includes a second counter and a second decoder, where a first terminal of the second counter is coupled with the circuit switching circuit, a second terminal of the second counter is coupled with a first terminal of the second decoder, a control terminal of the second counter is coupled with a second clock signal terminal, and a second terminal of the second decoder is coupled with the second transistor array.

In an embodiment, the circuit switching circuit includes a second comparator, a third comparator, an exclusive-NOR gate, a NOT gate, a first switch and a second switch, where a first input terminal of the second comparator is coupled with a second reference voltage terminal, a second input terminal of the second comparator is coupled with an output voltage terminal, and an output terminal of the second comparator is coupled with a first input terminal of the exclusive-NOR gate; a first input terminal of the third comparator is coupled with a third reference voltage terminal, a second input terminal of the third comparator is coupled with the output voltage terminal, and an output terminal of the third comparator is coupled with a second input terminal of the exclusive-NOR gate; an output terminal of the exclusive-NOR gate is coupled with an input terminal of the NOT gate, and an output of the exclusive-NOR gate is configured to control the first switch; an output of the NOT gate is configured to control the second switch; a first terminal of the first switch is coupled with an output terminal of the first comparator, and a second terminal of the first switch is coupled with the first voltage regulation control circuit; and a first terminal of the second switch is coupled with the output terminal of the first comparator, and a second terminal of the second switch is coupled with the second voltage regulation control circuit.

In an embodiment, a first terminal of the voltage regulation control circuit is coupled to the first comparator, a second terminal of the voltage regulation control circuit is coupled to the circuit switching circuit, and a control terminal of the voltage regulation control circuit is coupled to a clock signal terminal.

In an embodiment, the voltage regulation control circuit includes a shift register, where a first terminal of the shift register is coupled to the first comparator, a second terminal of the shift register is coupled to the circuit switching circuit, and a control terminal of the shift register is coupled to the clock signal terminal.

In an embodiment, the voltage regulation control circuit includes a counter and a decoder, where a first terminal of the counter is coupled to the output terminal of the first comparator, a second terminal of the counter is coupled to the first terminal of the decoder, a control terminal of the counter is coupled to the clock signal terminal, and a second terminal of the decoder is coupled to the circuit switching circuit.

In an embodiment, the circuit switching circuit includes a second comparator, a third comparator, an exclusive-NOR gate, a NOT gate, a first switch and a second switch; a first input terminal of the second comparator is coupled with a second reference voltage terminal, a second input terminal of the second comparator is coupled with an output voltage terminal, and an output terminal of the second comparator is coupled with a first input terminal of the exclusive-NOR gate; a first input terminal of the third comparator is coupled with a third reference voltage terminal, a second input terminal of the third comparator is coupled with the output voltage terminal, and an output terminal of the third comparator is coupled with a second input terminal of the exclusive-NOR gate; an output terminal of the exclusive-NOR gate is coupled with an input terminal of the NOT gate and is configured to control the first switch; an output terminal of the NOT gate is configured to control the second switch; a first terminal of the first switch is coupled with a second terminal of the voltage regulation control circuit, and a second terminal of the first switch is coupled with the first transistor array; and a first terminal of the second switch is coupled with a second terminal of the voltage regulation control circuit, and a second terminal of the second switch is coupled with the second transistor array.

In an embodiment, a first input terminal of the first comparator is coupled to a first reference voltage terminal, a second input terminal of the first comparator is coupled to an output voltage terminal, and an output terminal of the first comparator is coupled to the voltage regulation control circuit or the circuit switching circuit.

In an embodiment, a first terminal of a filter capacitor and a first terminal of a load resistor are coupled between second input terminals of the second comparator and the third comparator and the output voltage terminal, and a second terminal of the filter capacitor and a second terminal of the load resistor are both grounded.

In an embodiment, the first reference voltage is greater than the third reference voltage and less than the second reference voltage.

In an embodiment, the first clock signal terminal outputs the first clock signal, the second clock signal terminal outputs the second clock signal, and a frequency of the first clock signal is greater than a frequency of the second clock signal.

In an embodiment, the clock signal terminal outputs the first clock signal or the second clock signal, and a frequency of the first clock signal is greater than a frequency of the second clock signal.

Embodiments of the present disclosure further provide a method of regulating voltage by a digital voltage regulator, including: outputting, by a first comparator, a comparison result between a first reference voltage and an output voltage, and generating, by a voltage regulation control circuit, a voltage regulating signal, according to the comparison result output by the first comparator under control of a clock signal; and controlling, by a circuit switching circuit, one of a first transistor array and a second transistor array according to a comparison result between the output voltage and a second reference voltage and a comparison result between the output voltage and a third reference voltage to regulate the output voltage based on the voltage regulating signal.

In an embodiment, the first reference voltage is greater than the third reference voltage and less than the second reference voltage, and the clock signal includes a first clock signal and a second clock signal, and a frequency of the first clock signal is greater than a frequency of the second clock signal.

In an embodiment, outputting, by the first comparator, a comparison result between a first reference voltage and an output voltage, and generating, by a voltage regulation control circuit, a voltage regulating signal, according to the comparison result output by the first comparator, under control of a clock signal includes: comparing, by the first comparator, the output voltage with the first reference voltage, outputting, by the first comparator, a first comparison signal in response to that the output voltage is less than the first reference voltage, and generating, by the voltage regulation control circuit, a first voltage regulating signal according to the first comparison signal; and controlling, by the circuit switching circuit, one of a first transistor array and a second transistor array to regulate the output voltage according to a comparison result between the output voltage and a second reference voltage and a comparison result between the output voltage and a third reference voltage includes: comparing, by the circuit switching circuit, the output voltage with the third reference voltage, and in response to that the output voltage is less than the third reference voltage, the circuit switching circuit controls the voltage regulation control circuit to be electrically coupled with the first transistor array, and the voltage regulation control circuit controls, according to the first voltage regulating signal, the number of transistors to be turned on in the first transistor array to be increased, under control of the first clock signal, so as to increase the output voltage; or in response to that output voltage is greater than the third reference voltage, the circuit switching circuit controls the voltage regulation control circuit to be electrically coupled with the second transistor array, and the voltage regulation control circuit controls, through the first voltage regulating signal, the number of transistors to be turned on in the second transistor array to be increased, under control of the second clock signal, so as to increase the output voltage.

In an embodiment, outputting, by the first comparator, a comparison result between a first reference voltage and an output voltage, and generating, by a voltage regulation control circuit, a voltage regulating signal, according to the comparison result output by the first comparator, under control of a clock signal includes: comparing, by the first comparator, the output voltage with a first reference voltage, outputting, by the first comparator, a second comparison signal in response to that the output voltage is greater than the first reference voltage, and generating, by the voltage regulation control circuit, a second voltage regulating signal according to the second comparison signal; and controlling, by the circuit switching circuit, one of a first transistor array and a second transistor array to regulate the output voltage according to a comparison result between the output voltage and a second reference voltage and a comparison result between the output voltage and a third reference voltage includes: comparing, by the circuit switching circuit, the output voltage and the second reference voltage, and in response to that the output voltage is greater than the second reference voltage, the circuit switching circuit controls the voltage regulation control circuit to be electrically coupled with the first transistor array, and the voltage regulation control circuit controls, according to the second voltage regulating signal, the number of transistors to be turned on in the first transistor array to be decreased, under control of the first clock signal, so as to decrease the output voltage; or in response to that the output voltage is less than the second reference voltage, the circuit switching circuit controls the voltage regulation control circuit to be electrically coupled with the second transistor array, and the voltage regulation control circuit controls, according to the second voltage regulating signal, the number of transistors to be turned on in the second transistor array to be decreased, under control of the second clock signal, so as to decrease the output voltage.

DESCRIPTION OF EMBODIMENTS

In order to make those skilled in the art better understand technical solutions of the present disclosure, following detailed descriptions are given with reference to accompanying drawings and specific embodiments.

Technical terms or scientific terms used in the embodiments of the present disclosure should be given their ordinary meanings as understood by those having ordinary skill in the art to which the present disclosure belongs. Terms "first" and "second" and similar terms in the embodiments of the present disclosure do not intend to indicate any order, quantity, or importance, but are used to distinguish elements from each other. The word "including", "comprising", "includes" or "comprises", or the like in the embodiments of the present disclosure indicates that an element or item preceding the word contains an element or item listed after the word and equivalents thereof, without excluding other elements or items contained. The term "couple", "connect" or the like is not restricted to a physical or mechanical connection, but may include an electrical connection, whether direct or indirect.

Transistors in the first transistor array and the second transistor array in the embodiments of the present disclosure may be thin film transistors, field effect transistors, or other devices with features the same as those of thin film transistors or field effect transistors.

In addition, the transistors may be divided into N type transistors and P type transistors according to characteristics of the transistors, in response to that a P type transistor is employed, and in response to that a gate electrode of the P type transistor receives a low level, a source electrode and a drain electrode of the P type transistor are electrically coupled together. In response to that the gate electrode of the N type transistor receives a high level, the source electrode and the drain electrode are electrically coupled together. It is contemplated that N type transistors being employed will be readily apparent to those skilled in the art without inventive effort, and thus are within the scope of the embodiments of the present disclosure.

In a Low Dropout (LDO) digital voltage regulator, in response to that a transistor with a large current is employed in a PMOS transistor array, a stable voltage can be quickly achieved, but a low control accuracy is resulted in; in response to that a transistor with a small current is employed in the PMOS transistor array, a high control accuracy can be achieved, but a long time for regulating voltage is required. Therefore, it is difficult to achieve a high response speed and a high precision of output voltage by a traditional digital voltage regulator.

In view of above, the present disclosure provides a digital voltage regulator and a method of regulating voltage.

Figure 1:
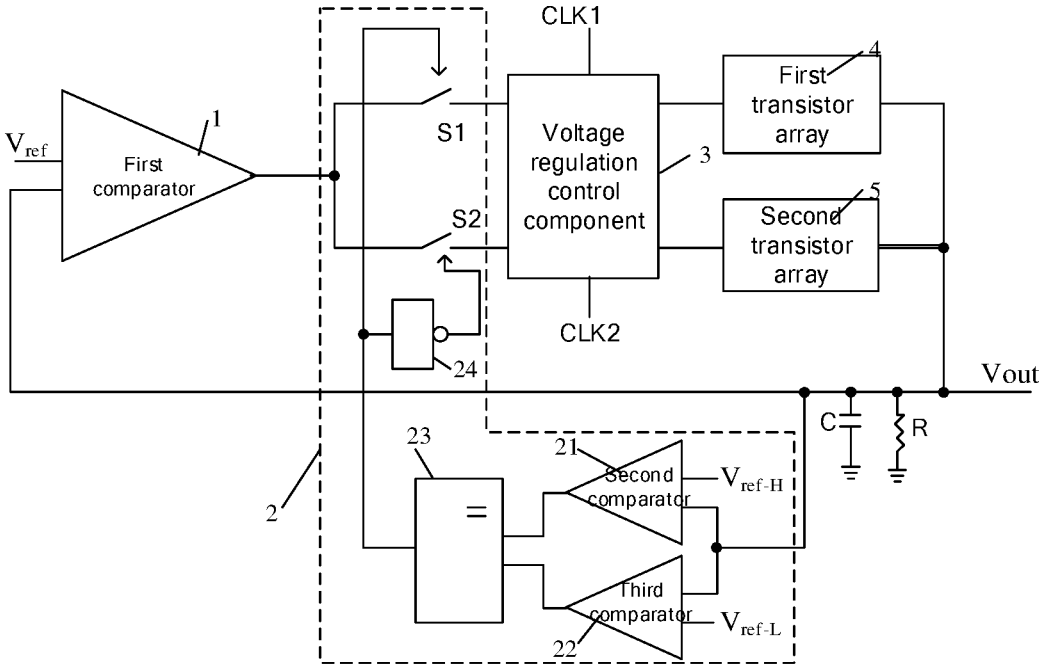
FIG. 1 is a schematic diagram of a digital voltage regulator according to an embodiment of the present disclosure.

As shown in FIG. 1, an embodiment of the present disclosure provides a digital voltage regulator, including a first comparator 1, a circuit switching circuit 2, a voltage regulation control circuit 3, a first transistor array 4 and a second transistor array 5, where a width-to-length ratio of any one of transistors in the first transistor array 4 is greater than a width-to-length ratio of any one of transistors in the second transistor array 5.

Specifically, the first comparator 1 is configured to output a comparison result between a first reference voltage $V_{ref}$ and an output voltage $V_{out}$ output by the digital voltage regulator; the voltage regulation control circuit 3 is configured to generate a voltage regulating signal according to the comparison result of the first comparator 1 under control of a clock signal; the circuit switching circuit 2 is configured to, according to a comparison result between the output voltage $V_{out}$ and a second reference voltage $V_{ref-H}$ and a comparison result between the output voltage $V_{out}$ and a third reference voltage $V_{ref-L}$, control a number of transistors in one of the first transistor array 4 and the second transistor array 5 to be turned on according to the voltage regulating signal output by the voltage regulation control circuit 3, so as to regulate the output voltage $V_{out}$ of the digital voltage regulator.

It should be noted that, in the embodiment of the present disclosure, voltage values of the first reference voltage $V_{ref}$, the second reference voltage $V_{ref-H}$, and the third reference voltage $V_{ref-L}$ are different from each other, and in the embodiment of the present disclosure, an example, in which the third reference voltage $V_{ref-L}$ is less than the first reference voltage $V_{ref}$, the first reference voltage $V_{ref}$ is less than the second reference voltage $V_{ref-H}$, the clock signal CLK includes a first clock signal CLK1 and a second clock signal CLK2, and a frequency of the first clock signal CLK1 is greater than a frequency of the second clock signal CLK2, that is, the first clock signal CLK1 is a high frequency clock signal, and the second clock signal CLK2 is a low frequency clock signal, is illustrated.

In following descriptions, a difference between the output voltage $V_{out}$ and the first reference voltage $V_{ref}$ is considered to be great in response to that the output voltage $V_{out}$ is less than the third reference voltage $V_{ref-L}$ or the output voltage $V_{out}$ is larger than the second reference voltage $V_{ref-H}$; in response to that the output voltage $V_{out}$ is larger than the third reference voltage $V_{ref-L}$ and less than the first reference voltage $V_{ref}$, or the output voltage $V_{out}$ is less than the second reference voltage $V_{ref-H}$ and larger than the first reference voltage $V_{ref}$, the difference between the output voltage $V_{out}$ and the first reference voltage $V_{ref}$ is considered to be small. Certainly, a determination of a magnitude of the difference between the output voltage $V_{out}$ and the first reference voltage $V_{ref}$ is not limited to foregoing conditions, and for a specific digital voltage regulator, the determination may be performed by comparing the difference between the output voltage $V_{out}$ and the first reference voltage $V_{ref}$ with a certain preset value.

Since two kinds of transistor arrays, i.e., the first transistor array 4 in which the width-to-length ratio of the transistor is relative large and the second transistor array 5 in which the width-to-length ratio is relative small, are employed in the embodiment of the present disclosure, therefore, in response to that the difference between the output voltage $V_{out}$ of the voltage regulator and the first reference voltage $V_{ref}$ is relative large, the circuit switching circuit 2 is controlled to select a branch, where the first comparator 1, the voltage regulation control circuit 3 and the first transistor array 4 are located, according to the comparison result between the output voltage $V_{out}$ and the second reference voltage $V_{ref-H}$ and the comparison result between the output voltage $V_{out}$ and the third reference voltage $V_{ref-L}$, in such way, the voltage regulation control circuit 3 may control a number of transistors in the first transistor array 4 to be turned on according to a first comparison signal (i.e., the comparison result between the output voltage $V_{out}$ of the voltage regulator and the first reference voltage $V_{ref}$) output by the first comparator 1, so as to make the output voltage $V_{out}$ quickly approach the reference voltage; in response to that the difference between the output voltage $V_{out}$ of the voltage regulator and the first reference voltage $V_{ref}$ is relative small, the circuit switching circuit 2 is controlled to select a branch, where the first comparator 1, the voltage regulation control circuit 3 and the second transistor array 5 are located, according to the comparison result between the output voltage $V_{out}$ and the second reference voltage $V_{ref-H}$ and the comparison result between the output voltage $V_{out}$ and the third reference voltage $V_{ref-L}$, so that the voltage regulation control circuit 3 controls a number of transistors in the second transistor array 5 to be turned on according to a second comparison signal (i.e., the comparison result between the output voltage $V_{out}$ of the voltage regulator and the first reference voltage $V_{ref}$) output by the first comparator 1, in such way, the output voltage $V_{out}$ is finely approach the first reference voltage, and the output voltage $V_{out}$ has a small ripple.

A method of relating voltage by the digital voltage regulator in the embodiment of the present disclosure is explained below with reference to FIG. 8.

Specifically, the output voltage $V_{out}$ is compared with the first reference voltage $V_{ref}$ by the first comparator 1, and in response to that the output voltage $V_{out}$ is less than the first reference voltage $V_{ref}$, the first comparator 1 outputs the first comparison signal, and the voltage regulation control circuit 3 generates a first voltage regulating signal according to the first comparison signal.

Since the output voltage $V_{out}$ is less than the first reference voltage $V_{ref}$, the first voltage regulating signal is a signal indicating to increase the output voltage $V_{out}$ and make the output voltage $V_{out}$ approach the first reference voltage $V_{ref}$.

The circuit switching circuit 2 compares the output voltage $V_{out}$ with the third reference voltage $V_{ref-L}$, in response to that the output voltage is less than the third reference voltage $V_{ref-L}$, the circuit switching circuit 2 controls the voltage regulation control circuit 3 to be electrically coupled with the first transistor array 4; the voltage regulation control circuit 3 generates the first voltage regulating signal under control of the first clock signal CLK1 to control the number of transistors to be turned on in the first transistor array 4 to be increased so as to increase the output voltage $V_{out}$.

Since the output voltage $V_{out}$ is less than the third reference voltage $V_{ref-L}$, and the third reference voltage $V_{ref-L}$ is less than the first reference voltage $V_{ref}$, the output voltage $V_{out}$ is considered to be relative large, so in the above method, by responding to the first transistor array 4 quickly with the first clock signal CLK1, i.e., a high frequency signal, more transistors in the first transistor array 4 are turned on according to the first voltage regulating signal, so as to enable the output voltage $V_{out}$ to approach the first reference voltage $V_{ref}$ quickly.

In response to that the output voltage $V_{out}$ is greater than the third reference voltage $V_{ref-L}$, the circuit switching circuit 2 controls the voltage regulation control circuit 3 to be electrically coupled with the second transistor array 5; the voltage regulation control circuit 3 generates the first voltage regulating signal under control of the second clock signal CLK2 to control the number of transistors to be turned on in the second transistor array 5 to be increased so as to increase the output voltage $V_{out}$.

Since the output voltage $V_{out}$ is less than the first reference voltage $V_{ref}$ and larger than the third reference voltage $V_{ref-L}$, and the difference between the output voltage $V_{out}$ and the first reference voltage $V_{ref}$ is not large, in the above method, by controlling the second transistor array 5 with the second clock signal CLK2, i.e., a low frequency signal, more transistors in the second transistor array 5 are turned on according to the first regulating signal, so that the output voltage $V_{out}$ approaches the first reference voltage $V_{ref}$ finely. The ripple of the output voltage $V_{out}$ can also be reduced.

The first comparator 1 compares the output voltage $V_{out}$ with the first reference voltage $V_{ref}$, in response to that the output voltage $V_{out}$ is greater than the first reference voltage $V_{ref}$, the first comparator 1 outputs a second comparison signal, and the voltage regulation control circuit 3 generates a second voltage regulating signal according to the second comparison signal.

Since the output voltage $V_{out}$ is greater than the first reference voltage $V_{ref}$, the second voltage regulating signal is a signal indicating to reduce the output voltage $V_{out}$.

The circuit switching circuit 2 compares the output voltage $V_{out}$ with the second reference voltage $V_{ref-H}$, in response to that the output voltage $V_{out}$ is greater than the second reference voltage $V_{ref-L}$, the circuit switching circuit 2 controls the voltage regulation control circuit 3 to be electrically coupled with the first transistor array 4, the voltage regulation control circuit 3 generates the second voltage regulating signal under control of the first clock signal CLK1 to control less transistors in the first transistor array 4 to be turned on, so as to lower the output voltage $V_{out}$.

Since the output voltage $V_{out}$ is larger than the second reference voltage $V_{ref-H}$, that is, the difference between the output voltage $V_{out}$ and the first reference voltage $V_{ref}$ is great, in the above method, the first transistor array 4 responses quickly with the first clock signal CKL1, i.e., the high frequency signal, the number of transistors to be turned in the first transistor array 4 are reduced according to the second voltage regulating signal, so that the output voltage $V_{out}$ approaches the first reference voltage $V_{ref}$ quickly.

In response to that the output voltage $V_{out}$ is less than the second reference voltage $V_{ref-H}$, the circuit switching circuit 2 controls the voltage regulation control circuit 3 to be electrically coupled to the second transistor array 5, and the voltage regulation control circuit 3 generates the second voltage regulating signal under control of the second clock signal CLK2 to control the number of transistors to be turned on in the second transistor array 5 to be reduced, so as to reduce the output voltage $V_{out}$.

Since the output voltage $V_{out}$ is less than the second reference voltage $V_{ref-H}$, that is, the difference between the output voltage $V_{out}$ and the first reference voltage $V_{ref}$ is not large, so in the above method, the second transistor array 5 is controlled by the second clock signal CLK2, that is, the low frequency signal, the number of transistors to be turned on in the second transistor array 5 are controlled to be decreased according to the first voltage regulating signal, so that the output voltage $V_{out}$ approaches the first reference voltage $V_{ref}$ finely. The ripple of the output voltage $V_{out}$ is also reduced.

It should be noted that, in the embodiment of the present disclosure, an initial value of the output voltage $V_{out}$ is 0V, that is, during an initial regulation of the digital voltage regulator, the output voltage $V_{out}$ is regulated according to a relationship between the first reference voltage $V_{ref}$ and the output voltage $V_{out}$ of 0V. During regulating the output voltage $V_{out}$, in response to that the number of transistors to be turned on is increased, a current passing through the first transistor array or the second transistor array is increased, so that the output voltage $V_{out}$ is increased, that is, the number of transistors to be turned on is positively correlated to the voltage value of the output voltage $V_{out}$.

Figure 2:
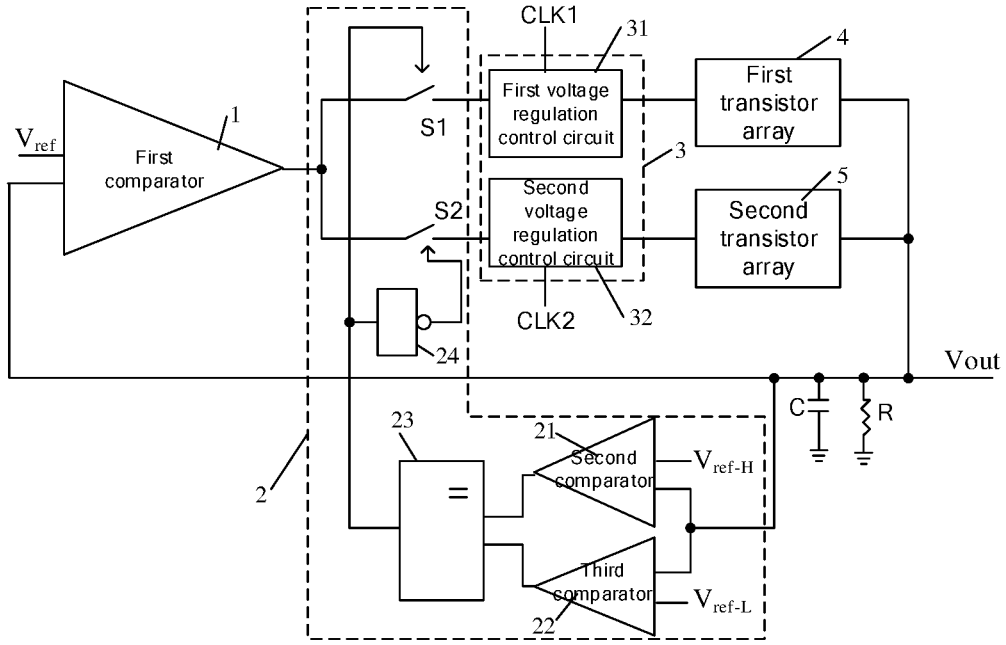
FIG. 2 is a schematic diagram of another digital voltage regulator according to an embodiment of the present disclosure.

As shown in FIG. 2, an embodiment of the present disclosure provides a digital voltage regulator, including: a first comparator 1, a circuit switching circuit 2, a voltage regulation control circuit 3, a first transistor array 4 and a second transistor array 5, where a width-to-length ratio of any one of transistors in the first transistor array 4 is greater than a width-to-length ratio of any one of transistors in the second transistor array 5. The voltage regulation control circuit 3 in the embodiment of the present disclosure includes a first voltage regulation control circuit 31 and a second voltage regulation control circuit 32. The first voltage regulation control circuit 31 is coupled between the circuit switching circuit 2 and the first transistor array 4, and the first voltage regulation control circuit 31 is configured to, in response to that the first voltage regulation control circuit 31 is electrically coupled with the first comparator 1 under control of the circuit switching circuit 2, generate the first voltage regulating signal according to the comparison result output by the first comparator 1 under control of the first clock signal CLK1, so as to control the number of transistors to be turned on in the first transistor array 4.

Specifically, in response to that the difference between the output voltage $V_{out}$ of the digital voltage regulator and the first reference voltage $V_{ref}$ is relative large, the circuit switching circuit 2 controls the first comparator 1 to be coupled with the first voltage regulation control circuit 31, so that the first voltage regulation control circuit 31 can control a corresponding number of transistors in the first transistor array 4 to be turned on according to comparison signals output by the first comparator 1 (for example, the first comparison signal indicating that the output voltage $V_{out}$ is less than the first reference voltage $V_{ref}$ and the second comparison signal indicating that the output voltage $V_{out}$ is greater than the first reference voltage $V_{ref}$), and since the width-to-length of the transistor in the first transistor array 4 is relative large, the output voltage $V_{out}$ is enabled to approach the first reference voltage $V_{ref}$ quickly.

The second voltage regulation control circuit 32 is coupled between the circuit switching circuit 2 and the second transistor array 5, and the second voltage regulation control circuit 32 is configured to, in response to being electrically coupled with the first comparator 1 under control of the circuit switching circuit 2, generate the second voltage regulating signal according to the comparison result output by the first comparator 1 under control of the second clock signal CLK2, so as to control the number of transistors to be turned on in the second transistor array 5.

Specifically, in response to that the difference between the output voltage $V_{out}$ of the digital voltage regulator and the first reference voltage $V_{ref}$ is relative small, the circuit switching circuit 2 controls the first comparator 1 to be electrically coupled to the second voltage regulation control circuit 32, so that the second voltage regulation control circuit 32 can control a corresponding number of transistors in the second transistor array 5 to be turned on according to comparison signals output by the first comparator 1 (for example, the first comparison signal indicating that the output voltage $V_{out}$ is less than the first reference voltage $V_{ref}$ and the second comparison signal indicating that the output voltage $V_{out}$ is greater than the first reference voltage $V_{ref}$), and since the width-to-length of the transistor in the second transistor array 5 is small, the output voltage $V_{out}$ is enabled to be finely approach the first reference voltage $V_{ref}$, and the ripple of the output voltage $V_{out}$ is relative small.

In the digital voltage regulator according to the embodiment of the present disclosure, the voltage regulation control circuit 3 includes the first voltage regulation control circuit 31 and the second voltage regulation control circuit 32, and the first voltage regulation circuit 31 is configured to control the transistors in the first transistor array 4 to respond quickly according to the first voltage regulating signal or the second voltage regulating signal under control of the first clock signal CLK1, that is, the high frequency signal, and a corresponding number of transistors are turned on or off, so that the output voltage $V_{out}$ approaches the first reference voltage $V_{ref}$ quickly; accordingly, the second voltage regulating circuit 32 is configured to control the transistors in the second transistor array 5 to respond finely according to the first voltage regulating signal or the second voltage regulating signal under control of the second clock signal CLK2, that is, the low frequency signal, and a corresponding number of transistors are turned on or off, so that the output voltage $V_{out}$ approaches the first reference voltage $V_{ref}$ finely, and the ripple of the output voltage $V_{out}$ is relative small. It can be seen that, in the embodiment of the present disclosure, the first voltage regulation control circuit 31 and the second voltage regulation control circuit 32 respectively control the first transistor array 4 and the second transistor array 5, so that the voltage regulation process of the digital voltage regulator is more flexible and accurate.

The circuit switching circuit 2 in the digital voltage regulator of the embodiment of the present disclosure may include: a second comparator 21, a third comparator 22, an exclusive-NOR gate 23, a NOT gate 24, a first switch S1 and a second switch S2.

Specifically, a first input terminal of the second comparator 21 is coupled to a second reference voltage terminal (for inputting a second reference voltage $V_{ref\text{-}H}$), a second input terminal of the second comparator 21 is coupled to an output voltage terminal, and an output terminal of the second comparator 21 is coupled to a first input terminal of the exclusive-NOR gate 23; a first input terminal of the third comparator 22 is coupled to a third reference voltage terminal (for inputting a third reference voltage $V_{ref\text{-}L}$), a second input terminal of the third comparator 22 is coupled to the output voltage terminal, and an output terminal of the third comparator 22 is coupled to a second input terminal of the exclusive-NOR gate 23; an output terminal of the exclusive-NOR gate 23 is coupled with an input terminal of the NOT gate 24 and controls the first switch S1; an output of the NOT gate 24 is configured to control the second switch S2; a first terminal of the first switch S1 is further coupled to the output terminal of the first comparator 1, and a second terminal of the first switch S1 is coupled to the first voltage regulation control circuit 31; a first terminal of the second switch S2 is further coupled to the output terminal of the first comparator 1, and a second terminal of the second switch S2 is coupled to the second voltage regulation control circuit 32.

Taking that the third reference voltage $V_{ref\text{-}L}$ is less than the first reference voltage $V_{ref}$ and the first reference voltage $V_{ref}$ is less than the second reference voltage $V_{ref\text{-}H}$ as an example, the method of regulating voltage by the digital voltage regulator in the embodiment of the present disclosure is described with reference to FIG. 8.

In following descriptions, the difference between the output voltage $V_{out}$ and the first reference voltage $V_{ref}$ is considered to be large in response to that the output voltage $V_{out}$ is less than the third reference voltage $V_{ref\text{-}L}$ or the output voltage $V_{out}$ is larger than the second reference voltage $V_{ref\text{-}H}$; in response to that the output voltage $V_{out}$ is larger than the third reference voltage $V_{ref\text{-}L}$ and less than the first reference voltage $V_{ref}$, or the output voltage $V_{out}$ is less than the second reference voltage $V_{ref\text{-}H}$ and larger than the first reference voltage $V_{ref}$, the difference between the output voltage $V_{out}$ and the first reference voltage $V_{ref}$ is considered to be small. Certainly, the determination of the magnitude of difference between the output voltage $V_{out}$ and the first reference voltage $V_{ref}$ is not limited to foregoing conditions, and, for a specific digital voltage regulator, the determination may be performed by comparing the difference between the output voltage $V_{out}$ and the first reference voltage $V_{ref}$ with a certain preset value.

In response to that the output voltage $V_{out}$ output by the output voltage terminal of the digital voltage regulator is less than the third reference voltage $V_{ref\text{-}L}$, it indicates that the output voltage $V_{out}$ is also less than the first reference voltage $V_{ref}$ and the second reference voltage $V_{ref\text{-}H}$, and the difference between the output voltage $V_{out}$ and the first reference voltage $V_{ref}$ is relative large; the second comparator 21 outputs 0 and the third comparator 22 also outputs 0, the exclusive-NOR gate 23 outputs 1, the first switch S1 is turned on, the NOT gate 24 outputs 0, the second switch S2 is turned off, and the first comparator 1 is electrically coupled with the first voltage regulation control circuit 31. Meanwhile, since the output voltage $V_{out}$ is less than the first reference voltage $V_{ref}$, the first comparator 1 outputs the first comparison signal being 0, and under control of the first clock signal CLK1, the first voltage regulation control circuit 31 controls the number of transistors to be turned on in the first transistor array 4 to be increased at a relative high frequency, so that the output voltage $V_{out}$ increases rapidly to approach the first reference voltage $V_{ref}$.

In response to that the output voltage $V_{out}$ is larger than the third reference voltage $V_{ref\text{-}L}$ and less than the first reference voltage $V_{ref}$, it indicates that the output voltage $V_{out}$ is also less than the second reference voltage $V_{ref\text{-}H}$, and the difference between the output voltage $V_{out}$ and the first reference voltage $V_{ref}$ is relative small; the second comparator 21 outputs 0, the third comparator 22 outputs 1, the exclusive-NOR gate 23 outputs 0, the first switch S1 is turned off, the NOT gate 24 outputs 1, the second switch S2 is turned on, and the first comparator 1 is electrically coupled with the second voltage regulation control circuit 32; meanwhile, since the output voltage $V_{out}$ is less than the first reference voltage $V_{ref}$, the first comparator 1 outputs the first comparison signal being 0, and under control of the second clock signal CLK2, the second voltage regulation control circuit 32 controls the number of transistors to be turned on in the second transistor array 5 to be increased at a relative low frequency, so that the output voltage $V_{out}$ is finely increased to approach the first reference voltage $V_{ref}$, and the ripple of the output voltage $V_{out}$ is relative small.

In response to that the output voltage $V_{out}$ is larger than the first reference voltage $V_{ref}$ and less than the second reference voltage $V_{ref\text{-}H}$, it indicates that the output voltage $V_{out}$ is larger than the third reference voltage $V_{ref\text{-}L}$, and the difference between the output voltage $V_{out}$ and the first reference voltage $V_{ref}$ is relative small; the second comparator 21 outputs 0, the third comparator 22 outputs 1, the exclusive-NOR gate 23 outputs 0, the first switch S1 is turned off, the NOT gate 24 outputs 1, the second switch S2 is turned on, and the first comparator 1 is electrically coupled with the second voltage regulation control circuit 32; meanwhile, since the output voltage $V_{out}$ is greater than the first reference voltage $V_{ref}$, the first comparator 1 outputs the second comparison signal being 1, and under control of the second clock signal CLK2, the second voltage regulation control circuit 32 controls the number of transistors to be turned on in the second transistor array 5 to be decreased at a relative low frequency, so that the output voltage $V_{out}$ is finely decreased to approach the first reference voltage $V_{ref}$, and the ripple of the output voltage $V_{out}$ is relative small.

In response to that the output voltage $V_{out}$ is larger than the second reference voltage $V_{ref\text{-}H}$, it indicates that the output voltage $V_{out}$ is larger than the first reference voltage $V_{ref}$ and the second reference voltage $V_{ref\text{-}H}$, and the difference between the output voltage $V_{out}$ and the first reference voltage $V_{ref}$ is relative large; the second comparator 21 outputs 1, the third comparator 22 also outputs 1, the exclusive-NOR gate 23 outputs 1, the first switch S1 is turned on, the NOT gate 24 outputs 0, the second switch S2 is turned off, and the first comparator 1 is electrically coupled with the first voltage regulation control circuit 31. Meanwhile, since the output voltage $V_{out}$ is greater than the first reference voltage $V_{ref}$, the first comparator 1 outputs the second comparison signal being 1, and under control of the first clock signal CLK1, the first voltage regulation control circuit 31 controls the number of transistors to be turned on in the first transistor array 4 to be decreased at a high frequency, so that the output voltage $V_{out}$ is rapidly decreased to approach the first reference voltage $V_{ref}$.

In summary, in the digital voltage regulator provided in the embodiment of the present disclosure, in response to that the difference between the output voltage $V_{out}$ and the first reference voltage $V_{ref}$ is relative large, the first transistor array 4 with the transistor having the large width-to-length ratio is employed to make the output voltage $V_{out}$ approach the first reference voltage $V_{ref}$ quickly; in response to that the difference between the output voltage $V_{out}$ and the first reference voltage $V_{ref}$ is relative small, the second transistor array 5 with the transistor having the small width-to-length ratio is employed to make the output voltage $V_{out}$ approach the first reference voltage $V_{ref}$ finely, and the ripple of the output voltage $V_{out}$ is relative small.

Figure 3:
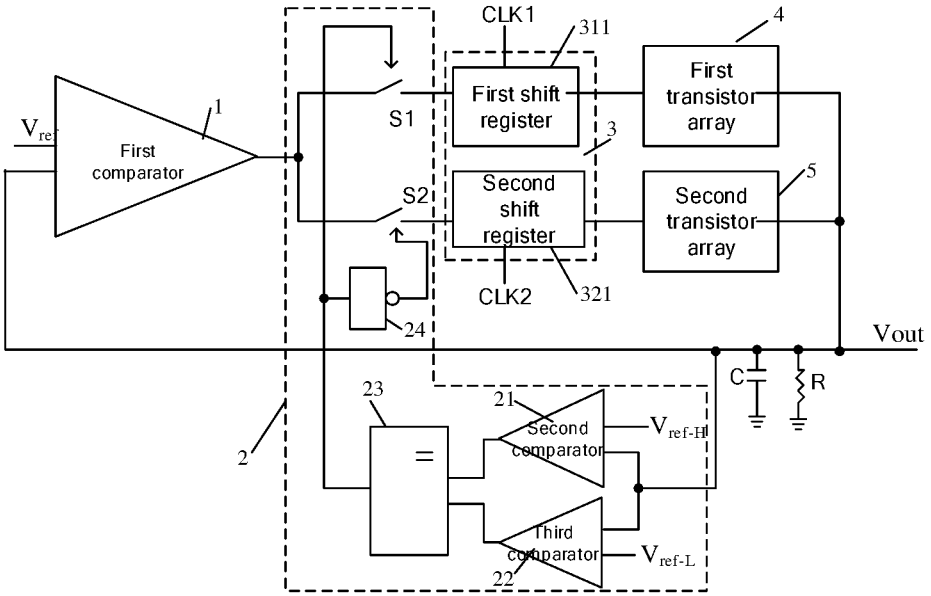
FIG. 3 is a schematic diagram of another digital voltage regulator according to an embodiment of the present disclosure.

As shown in FIG. 3, an embodiment of the present disclosure provides a digital voltage regulator, including a first comparator 1, a circuit switching circuit 2, a first voltage regulation control circuit 31, a second voltage regulation control circuit 32, a first transistor array 4 and a second transistor array 5, where a width-to-length ratio of any one of transistors in the first transistor array 4 is greater than a width-to-length ratio of any one of transistors in the second transistor array 5. The first voltage regulation control circuit 31 in the embodiment of the present disclosure includes a first shift register 311, and the second voltage regulation control circuit 32 includes a second shift register 321. A first terminal of the first shift register 311 is coupled to the circuit switching circuit 2, a second terminal of the first shift register 311 is coupled to the first transistor array 4, and a control terminal of the first shift register 311 is coupled to a first clock signal terminal; a first terminal of the second shift register 321 is coupled to the circuit switching circuit 2, a second terminal of the second shift register 321 is coupled to the second transistor array 5, and a control terminal of the second shift register is coupled to a second clock signal terminal.

It should be noted that structures of the first shift register 311 and the second shift register 321 are the same with each other.

The circuit switching circuit 2 in the embodiment of the present disclosure may be the same as the circuit switching circuit 2 shown in FIG. 2, that is, includes a second comparator 21, a third comparator 22, an exclusive-NOR gate 23, a NOT gate 24, a first switch S1 and a second switch S2.

The digital voltage regulator according to the embodiment of the present disclosure will be described with reference to FIG. 3.

Specifically, a first input terminal of the first comparator 1 is coupled to a first reference voltage terminal (for inputting a first reference voltage $V_{ref}$), a second input terminal of the first comparator 1 is coupled to an output voltage terminal (for outputting an output voltage $V_{out}$), and an output terminal of the first comparator 1 is coupled to a first terminal of the first switch S1 and a first terminal of the second switch S2; a first input terminal of the second comparator 21 is coupled to a second reference voltage terminal (for inputting a second reference voltage $V_{ref\text{-}H}$), a second input terminal of the second comparator 21 is coupled to the output voltage terminal, and an output terminal of the second comparator 21 is coupled to a first input terminal of the exclusive-NOR gate 23; a first input terminal of the third comparator 22 is coupled to a third reference voltage terminal (for inputting a third reference voltage $V_{ref\text{-}L}$), a second input terminal of the third comparator 22 is coupled to the output voltage terminal, and an output terminal of the third comparator 22 is coupled to a second input terminal of the exclusive-NOR gate 23; an output terminal of the exclusive-NOR gate 23 is coupled with an input terminal of the NOT gate 24 and controls the first switch S1; an output of the NOT gate 24 is configured to control the second switch S2; a second terminal of the first switch S1 is coupled to a first terminal of the first shift register 311; a second terminal of the second switch S2 is coupled to a first terminal of the second shift register 321; a second terminal of the first shift register 311 is coupled to a first terminal of the first transistor array 4, and a control terminal of the first shift register 311 is coupled to a first clock signal terminal (for inputting a first clock signal CLK1); a second terminal of the second shift register 321 is coupled to a first terminal of the second transistor array 5, and a control terminal of the second shift register 321 is coupled to a second clock signal terminal (for inputting a second clock signal CLK2); a second terminal of the first transistor array 4 and a second terminal of the second transistor array 5 are both coupled to the output voltage terminal. Certainly, it should be understood that the digital voltage regulator also includes circuits such as a filter capacitor C and a load resistor R; first terminals of the filter capacitor C and the load resistor R are both coupled to the output voltage terminal, and second terminals of the filter capacitor C and the load resistor R may be grounded.

Taking the third reference voltage $V_{ref\text{-}L}$ being less than the first reference voltage $V_{ref}$ and the first reference voltage $V_{ref}$ being less than the second reference voltage $V_{ref\text{-}H}$ as an example, the method of regulating voltage by the digital voltage regulator in the embodiment of the present disclosure is described with reference to FIG. 8.

In following descriptions, the difference between the output voltage $V_{out}$ and the first reference voltage $V_{ref}$ is considered to be relative large in response to that the output voltage $V_{out}$ is less than the third reference voltage $V_{ref\text{-}L}$ or the output voltage $V_{out}$ is larger than the second reference voltage $V_{ref\text{-}H}$; in response to that the output voltage $V_{out}$ is larger than the third reference voltage $V_{ref\text{-}L}$ and less than the first reference voltage $V_{ref}$, or the output voltage $V_{out}$ is less than the second reference voltage $V_{ref\text{-}H}$ and larger than the first reference voltage $V_{ref}$, the difference between the output voltage $V_{out}$ and the first reference voltage $V_{ref}$ is considered to be relative small. Certainly, a determination of a magnitude of difference between the output voltage $V_{out}$ and the first reference voltage $V_{ref}$ is not limited to foregoing conditions, and for a specific digital voltage regulator, the determination may be performed by comparing the difference between the output voltage $V_{out}$ and the first reference voltage $V_{ref}$ with a certain preset value.

In response to that the output voltage $V_{out}$ output by the output voltage terminal of the digital voltage regulator is less than the third reference voltage $V_{ref\text{-}L}$ input by the third reference voltage terminal, it indicates that the output voltage $V_{out}$ is also less than the first reference voltage $V_{ref}$ input by the first reference voltage terminal and the second reference voltage $V_{ref\text{-}H}$ input by the second reference voltage terminal, and the difference between the output voltage $V_{out}$ and the first reference voltage $V_{ref}$ is relative large; the output terminal of the second comparator 21 outputs 0, the output terminal of the third comparator 22 also outputs 0, the output terminal of the exclusive-NOR gate 23 outputs 1, the first switch S1 is turned on, the NOT gate 24 outputs 0, the second switch S2 is turned off, and the output terminal of the first comparator 1 is electrically coupled to the first terminal of the first shift register 311 through the first switch S1.

Meanwhile, since the output voltage $V_{out}$ is less than the first reference voltage $V_{ref}$, and a first comparison signal being 0 is output from the output terminal of the first comparator 1, the first shift register 311 is controlled by a first clock signal CLK1 with a high frequency input from the first clock signal terminal to shift right, so as to control the number of transistors to be turned on in the first transistor array 4 to be increased at a high frequency, so that the output voltage $V_{out}$ increases rapidly to approach the first reference voltage $V_{ref}$.

In response to that the output voltage $V_{out}$ output by the output voltage terminal is greater than the third reference voltage $V_{ref\text{-}L}$ input by the third reference voltage terminal and less than the first reference voltage $V_{ref}$ input by the first reference voltage terminal, it indicates that the output voltage $V_{out}$ is also less than the second reference voltage $V_{ref\text{-}H}$ of the second reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the output terminal of the NOT gate 24 outputs 1, the second switch S2 is turned on, and the output terminal of the first comparator 1 is electrically coupled with the first terminal of the second shift register 321 through the second switch S2; meanwhile, since the output voltage $V_{out}$ is less than the first reference voltage $V_{ref}$, the output terminal of the first comparator 1 outputs 0, and the second shift register 321 shifts right under control of the second clock signal CLK2 with a low frequency input at the second clock signal terminal, so as to control the number of transistors to be turned on in the second transistor array 5 to be increased with a relative low frequency, so that the output voltage $V_{out}$ increases finely to approach the first reference voltage $V_{ref}$, and the ripple of the output voltage Vout is relative small.

In response to that the output voltage $V_{out}$ output by the output voltage terminal is greater than the first reference voltage $V_{ref}$ input by the first reference voltage terminal and is less than the second reference voltage $V_{ref\text{-}H}$ input by the second reference voltage terminal, it indicates that the output voltage $V_{out}$ is greater than the third reference voltage $V_{ref\text{-}L}$ input by the third reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the output terminal of the first comparator is electrically coupled to the first terminal of the second shift register 321 through the second switch S2; meanwhile, since the output voltage $V_{out}$ is greater than the first reference voltage $V_{ref}$, the first comparator 1 outputs 1, and the second shift register 321 shifts left under control of the second clock signal CLK2 with a low frequency input at the second clock signal terminal, so that the number of transistors to be turned on in the second transistor array 5 is controlled to be decreased at a relative low frequency, so that the output voltage $V_{out}$ decreases finely to approach the first reference voltage $V_{ref}$, and the ripple of the output voltage $V_{out}$ is relative small.

In response to that the output voltage $V_{out}$ output by the output voltage terminal is greater than the second reference voltage $V_{ref\text{-}H}$ input by the second reference voltage terminal, it indicates that the output voltage $V_{out}$ is greater than the first reference voltage $V_{ref}$ input by the first reference voltage terminal and the second reference voltage $V_{ref\text{-}H}$ input by the second reference voltage terminal, and the difference between the output voltage $V_{out}$ and the first reference voltage $V_{ref}$ is relative large; the output terminal of the second comparator 21 outputs 1, the output terminal of the third comparator 22 also outputs 1, the output terminal of the exclusive-NOR gate 23 outputs 1, the first switch S1 is turned on, the NOT gate 24 outputs 0, the second switch S2 is turned off, and the output terminal of the first comparator 1 is electrically coupled to the first terminal of the first shift register 311 through the first switch S1. Meanwhile, since the output voltage $V_{out}$ is greater than the first reference voltage $V_{ref}$, the first comparator 1 outputs a second comparison signal being 1, and the first shift register 311 shifts left under control of the first clock signal CLK1 with the high frequency input at the first clock signal terminal, so as to control the number of transistors to be turned on in the first transistor array 4 to be reduced at a relative high frequency, so that the output voltage $V_{out}$ is rapidly decreased to approach the first reference voltage $V_{ref}$.

In summary, in the digital voltage regulator provided in the embodiment of the present disclosure, in response to that the difference between the output voltage $V_{out}$ and the first reference voltage $V_{ref}$ is relative large, the first transistor array 4 with transistors each having a large width-to-length ratio is employed by the first shift register 311 under control of the first clock signal CLK1 with the high frequency to make the output voltage $V_{out}$ approach the first reference voltage $V_{ref}$ quickly; in response to that the difference between the output voltage $V_{out}$ and the first reference voltage $V_{ref}$ is relative small, the second shift register 321 makes the output voltage $V_{out}$ approach the first reference voltage $V_{ref}$ finely by employing the second transistor array 5 with transistors each having a small width-to-length ratio under control of the second clock signal CLK2 with a low frequency, and the ripple of the output voltage $V_{out}$ is relative small.

Figure 4:
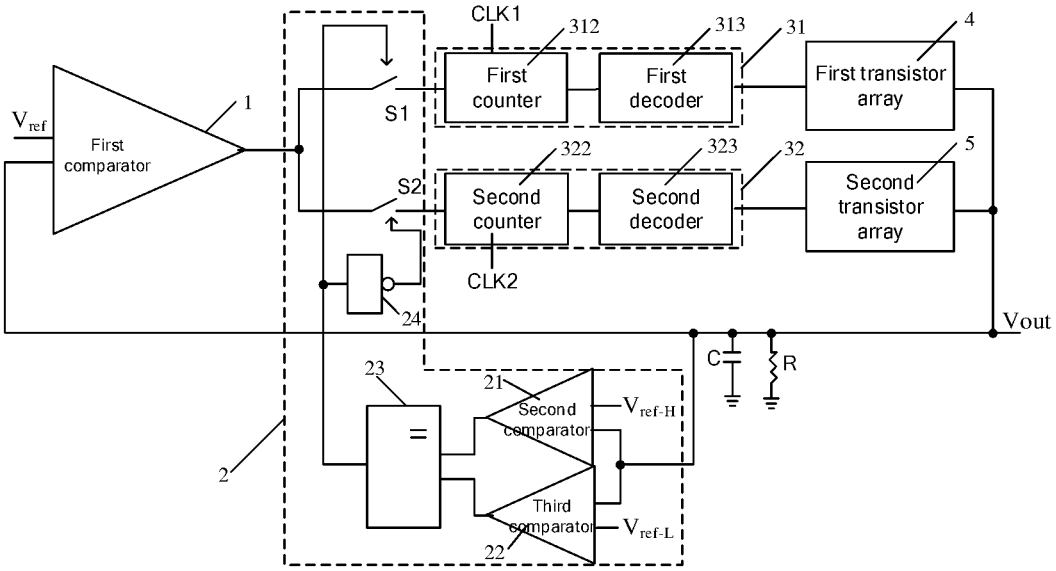
FIG. 4 is a schematic diagram of another digital voltage regulator according to an embodiment of the present disclosure.

As shown in FIG. 4, the present disclosure provides a digital voltage regulator having a structure substantially the same as the voltage regulator shown in FIG. 3, and also includes a first comparator 1, a circuit switching circuit 2, a first voltage regulation control circuit 31, a second voltage regulation control circuit 32, a first transistor array 4 and a second transistor array 5, where a width-to-length ratio of any one of transistors in the first transistor array 4 is greater than a width-to-length ratio of any one of transistors in the second transistor array 5. The digital voltage regulator in the present embodiment is different from the voltage regulator shown in FIG. 3 in that: the first voltage regulation control circuit 31 in the embodiment of the present disclosure includes a first counter 312 and a first decoder 313, and the second voltage regulation control circuit 32 includes a second counter 322 and a second decoder 323, where a first terminal of the first counter 312 is coupled to the circuit switching circuit 2, a second terminal of the first counter 312 is coupled to a first terminal of the first decoder 313, and a control terminal of the first counter 312 is coupled to a first clock signal terminal; a second terminal of the first decoder 313 is coupled to the first transistor array 4; a first terminal of the second counter 322 is coupled to the circuit switching circuit 2, a second terminal of the second counter 322 is coupled to a first terminal of the second decoder 323, and a control terminal of the second counter 322 is coupled to a second clock signal terminal; a second terminal of the second decoder 323 is coupled to the second transistor array 5.

The circuit switching circuit 2 in the embodiment of the present disclosure may be the same as those shown in FIGS. 2 and 3, that is, includes a second comparator 21, a third comparator 22, an exclusive-NOR gate 23, a NOT gate 24, a first switch S1 and a second switch S2.

The digital voltage regulator according to the embodiment of the present disclosure will be described with reference to FIG. 4.

Specifically, a first input terminal of the first comparator 1 is coupled to a first reference voltage terminal (for inputting a first reference voltage $V_{ref}$), a second input terminal of the first comparator 1 is coupled to an output voltage terminal (for outputting an output voltage $V_{out}$), and an output terminal of the first comparator 1 is coupled to a first terminal of the first switch S1 and a first terminal of the second switch S2; a first input terminal of the second comparator 21 is coupled to a second reference voltage terminal (for inputting a second reference voltage $V_{ref-H}$), a second input terminal of the second comparator 21 is coupled to the output voltage terminal, and an output terminal of the second comparator 21 is coupled to a first input terminal of the exclusive-NOR gate 23; a first input terminal of the third comparator 22 is coupled to a third reference voltage terminal (for inputting a third reference voltage $V_{ref-L}$), a second input terminal of the third comparator 22 is coupled to the output voltage terminal, and an output terminal of the third comparator 22 is coupled to a second input terminal of the exclusive-NOR gate 23; an output terminal of the exclusive-NOR gate 23 is coupled with an input terminal of the NOT gate 24 and controls the first switch S1; an output of the not gate 24 is configured to control the second switch S2; a second terminal of the first switch S1 is coupled to a first terminal of the first counter 312; a second terminal of the second switch S2 is coupled to a first terminal of the second counter 322; a second terminal of the first counter 312 is coupled to a first terminal of the first decoder 313, and a control terminal of the first counter 312 is coupled to a first clock signal terminal; a second terminal of the second counter 322 is coupled to a first terminal of the second counter 322, and a control terminal of the second counter 322 is coupled to a second clock signal terminal; a second terminal of the first decoder 313 is coupled to a first terminal of the first transistor array 4; a second terminal of the second decoder 323 is coupled to a first terminal of the second transistor array 5; a second terminal of the first transistor array 4 and a second terminal of the second transistor array 5 are both coupled to the output voltage terminal. Certainly, it should be understood that the digital voltage regulator also includes circuits such as a filter capacitor C and a load resistor R; first terminals of the filter capacitor C and the load resistor R are both coupled to the output voltage terminal, and second terminals of the filter capacitor C and the load resistor R may be grounded.

Taking the third reference voltage $V_{ref-L}$ being less than the first reference voltage $V_{ref}$ and the first reference voltage $V_{ref}$ being less than the second reference voltage $V_{ref-H}$ as an example, the method of regulating voltage by the digital voltage regulator in the embodiment of the present disclosure is described with reference to FIG. 8.

In following descriptions, the difference between the output voltage $V_{out}$ and the first reference voltage $V_{ref}$ is considered to be relative large in response to that the output voltage $V_{out}$ is less than the third reference voltage $V_{ref-L}$ or the output voltage $V_{out}$ is larger than the second reference voltage $V_{ref-H}$; in response to that the output voltage $V_{out}$ is larger than the third reference voltage $V_{ref-L}$ and less than the first reference voltage $V_{ref}$, or the output voltage $V_{out}$ is less than the second reference voltage $V_{ref-H}$ and larger than the first reference voltage $V_{ref}$, the difference between the output voltage $V_{out}$ and the first reference voltage $V_{ref}$ is considered to be relative small. Certainly, a determination of a magnitude of difference between the output voltage $V_{out}$ and the first reference voltage $V_{ref}$ is not limited to foregoing conditions, and for a specific digital voltage regulator, the determination may be performed by comparing the difference between the output voltage $V_{out}$ and the first reference voltage $V_{ref}$ with a certain preset value.

In response to that the output voltage $V_{out}$ output by the output voltage terminal of the digital voltage regulator is less than the third reference voltage $V_{ref-L}$ input by the third reference voltage terminal, it indicates that the output voltage $V_{out}$ is also less than the first reference voltage $V_{ref}$ input by the first reference voltage terminal and the second reference voltage $V_{ref-H}$ input by the second reference voltage terminal, and the difference between the output voltage $V_{out}$ and the first reference voltage $V_{ref}$ is relative large; the output terminal of the second comparator 21 outputs 0, the output terminal of the third comparator 22 also outputs 0, the output terminal of the exclusive-NOR gate 23 outputs 1, the first switch S1 is turned on, the NOT gate 24 outputs 0, the second switch S2 is turned off, and the output terminal of the first comparator 1 is electrically coupled to the first terminal of the first counter 312 through the first switch S1. Meanwhile, since the output voltage $V_{out}$ is less than the first reference voltage $V_{ref}$, the output terminal of the first comparator 1 outputs 0, the first counter 312 increases in value under control of the first clock signal CLK1 input from the first clock signal terminal and outputs an increased value to the first decoder 313, and the first decoder 313 controls the number of transistors to be turned on in the first transistor array 4 to be increased, so that the output voltage $V_{out}$ rapidly increases to approach the first reference voltage $V_{ref}$.

Here, since an initial value of the output voltage is 0V, initial values of the first counter 312 and the second counter 321 are both 0. The first counter 312 and the second counter 321 may be chosen to be binary or hexadecimal, which may be determined according to a specific structure of the digital voltage regulator.

In response to that the output voltage $V_{out}$ output by the output voltage terminal is greater than the third reference voltage $V_{ref-L}$ input by the third reference voltage terminal and is less than the first reference voltage $V_{ref}$ input by the first reference voltage terminal, it indicates that the output voltage $V_{out}$ is also less than the second reference voltage $V_{ref-H}$ input by the second reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the output terminal of the first comparator 1 is electrically coupled with the first terminal of the second counter 322 through the second switch S2; meanwhile, since the output voltage $V_{out}$ is less than the first reference voltage $V_{ref}$, the output terminal of the first comparator 1 outputs 0, the second counter 322 increases in value under control of the second clock signal CLK2 input from the second clock signal terminal, and outputs an increased value to the second decoder 323, and the second decoder 323 controls the number of transistors to be turned on in the second transistor array 5 to be increased, so that the output voltage $V_{out}$ increases finely to approach the first reference voltage $V_{ref}$, and the ripple of the output voltage $V_{out}$ is relative small.

In response to that the output voltage $V_{out}$ output by the output voltage terminal is greater than the first reference voltage $V_{ref}$ input by the first reference voltage terminal and is less than the second reference voltage $V_{ref-H}$ input by the second reference voltage terminal, it indicates that the output voltage $V_{out}$ is greater than the third reference voltage $V_{ref-L}$ input by the third reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the output terminal of the first comparator is electrically coupled to the first terminal of the second decoder 323 through the second switch S2; meanwhile, since the output voltage $V_{out}$ is greater than the first reference voltage $V_{ref}$, the first comparator 1 outputs 1, the second counter 322 decreases in value under control of the second clock signal CLK2 input from the second clock signal terminal, and then outputs a decreased value to the second decoder 323, and the second decoder 323 controls the number of transistors to turned on in the second transistor array 5 to be decreased, so that the output voltage $V_{out}$ is finely decreased to approach the first reference voltage $V_{ref}$, and the ripple of the output voltage $V_{out}$ is relative small.

In response to that the output voltage $V_{out}$ output by the output voltage terminal is greater than the second reference voltage $V_{ref-H}$ input by the second reference voltage terminal, it indicates that the output voltage $V_{out}$ is greater than the first reference voltage $V_{ref}$ input by the first reference voltage terminal and the second reference voltage $V_{ref-H}$ input by the second reference voltage terminal, and the difference between the output voltage $V_{out}$ and the first reference voltage $V_{ref}$ is relative large; the output terminal of the second comparator 21 outputs 1, the output terminal of the third comparator 22 also outputs 1, the output terminal of the exclusive-NOR gate 23 outputs 1, the first switch S1 is turned on, the NOT gate 24 outputs 0, the second switch S2 is turned off, and the output terminal of the first comparator 1 is electrically coupled to the first terminal of the first counter 312 through the first switch S1. Meanwhile, since the output voltage $V_{out}$ is greater than the first reference voltage $V_{ref}$, the output terminal of the first comparator 1 outputs 1, the first counter 312 decreases in value under control of the first clock signal CLK1 input at the first clock signal terminal, and then outputs a decreased value to the first decoder 313, and the first decoder 313 controls the number of transistors to be turned on in the first transistor array 4 to be decreased, so that the output voltage $V_{out}$ decreases rapidly to approach the first reference voltage $V_{ref}$.

In summary, in the digital voltage regulator provided in the embodiment of the present disclosure, in response to that the difference between the output voltage $V_{out}$ and the first reference voltage $V_{ref}$ is relative large, the first counter 312 is increased or decreased in value under control of the first clock signal CLK1, and then outputs the increased or decreased value to the first decoder 313, and the first decoder 313 controls the first transistor array 4 with the transistor having the large width-to-length ratio to enable the output voltage $V_{out}$ to rapidly approach the first reference voltage $V_{ref}$; in response to that the difference between the output voltage $V_{out}$ and the first reference voltage $V_{ref}$ is relative small, the second counter 322 increases or decreases in value under control of the second clock signal CLK2, and then outputs the increased or decreased value to the second decoder 323, and the second decoder 323 controls the second transistor array 5 with the transistor having the small width-to-length ratio to make the output voltage $V_{out}$ approach the first reference voltage $V_{ref}$ finely, and the ripple of the output voltage $V_{out}$ is relative small.

Figure 5:
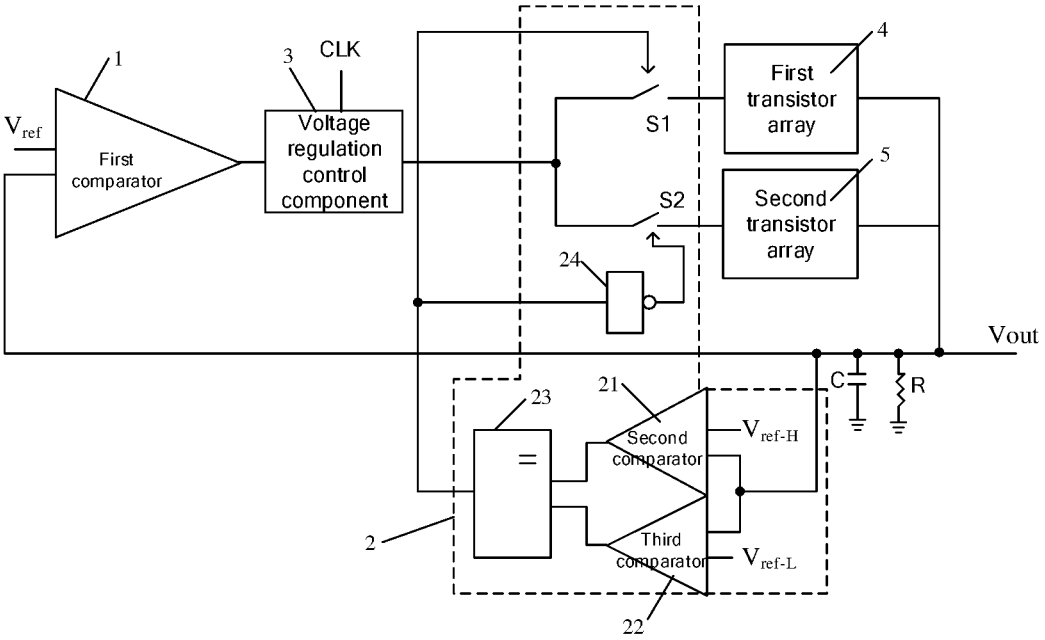
FIG. 5 is a schematic diagram of another digital voltage regulator according to an embodiment of the present disclosure.

As shown in FIG. 5, an embodiment of the present disclosure provides a digital voltage regulator, including a first comparator 1, a circuit switching circuit 2, a voltage regulation control circuit 3, a first transistor array 4 and a second transistor array 5, where a width-to-length ratio of any one of transistors in the first transistor array 4 is greater than a width-to-length ratio of any one of transistors in the second transistor array 5.

Specifically, in the embodiment of the present disclosure, the voltage regulation control circuit 3 is coupled between an output terminal of the first comparator 1 and the circuit switching circuit 2. That is, a first terminal of the voltage regulation control circuit 3 is coupled to an output terminal of the first comparator 1, a second terminal of the voltage regulation control circuit 3 is coupled to the circuit switching circuit 2, and a control terminal of the voltage regulation control circuit 3 is coupled to a clock signal terminal (for providing a clock signal CLK). In such case, the number of transistors to be turned on in two transistor arrays (the first transistor array 4 and the second transistor array 5) can be controlled by the voltage regulation control circuit 3, and the digital voltage regulator includes only one voltage regulation control circuit, so that the structure thereof is simple.

The clock signal terminal may output a clock signal CLK with a varied frequency according to a relationship between the output voltage $V_{out}$ and the first reference voltage $V_{ref}$. Specifically, in response to that a difference between the output voltage $V_{out}$ and the first reference voltage $V_{ref}$ is relative large, the clock signal terminal outputs a first clock signal CLK1 with a high frequency, and in response to that the difference between the output voltage $V_{out}$ and the first reference voltage $V_{ref}$ is relative small, the clock signal terminal outputs a second clock signal CLK2 with a low frequency. Certainly, the clock signal terminal may include a first clock signal terminal for providing the first clock signal CLK1 and a second clock signal terminal for providing the second clock signal CLK2.

Figure 6:
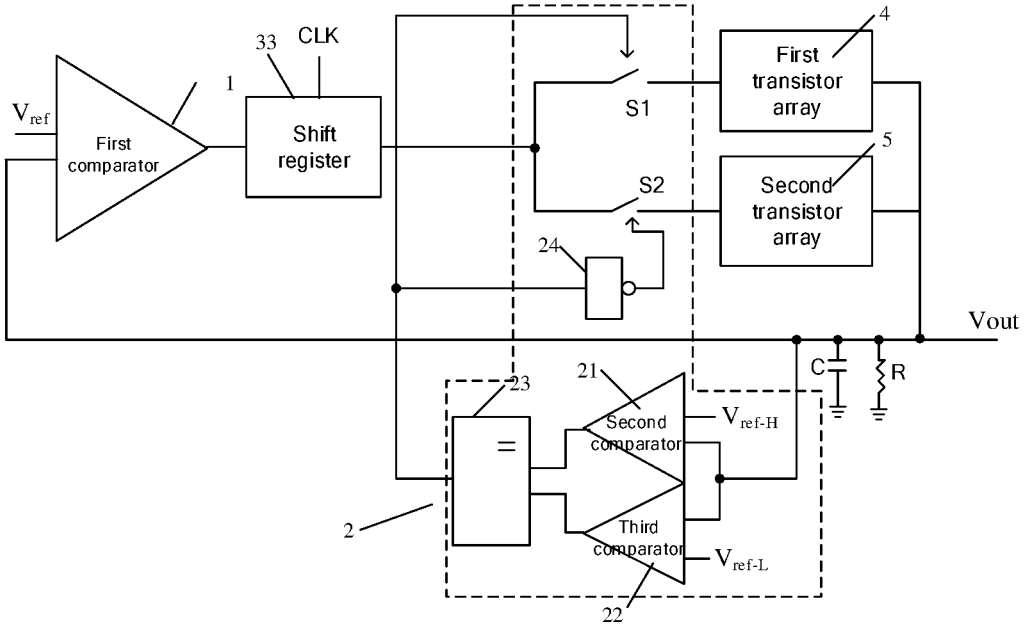
FIG. 6 is a detailed schematic diagram of a digital voltage regulator according to an embodiment of the present disclosure.

As shown in FIG. 6, the voltage regulation control circuit 3 may be a shift register 33, a first terminal of the shift register 33 is coupled to the output terminal of the first comparator 1, a second terminal of the shift register 33 is coupled to the circuit switching circuit 2, and a control terminal of the shift register 33 is coupled to the clock signal terminal.

The circuit switching circuit 2 in the embodiment of the present disclosure may be the same as the circuit switching circuit 2 shown in FIG. 2, that is, includes a second comparator 21, a third comparator 22, an exclusive-NOR gate 23, a NOT gate 24, a first switch S1 and a second switch S2.

The digital voltage regulator according to the embodiment of the present disclosure will be described with reference to FIG. 6.

Specifically, a first input terminal of the first comparator 1 is coupled to a first reference voltage terminal (for inputting a first reference voltage $V_{ref}$), a second input terminal of the first comparator 1 is coupled to an output voltage terminal (for outputting an output voltage $V_{out}$), and an output terminal of the first comparator 1 is coupled to a first terminal of the shift register 33; a second terminal of the shift register 33 is coupled to a first terminal of the first switch S1 and a first terminal of the second switch S2, and a control terminal of the shift register 33 is coupled to a clock signal terminal (for inputting a clock signal); a first input terminal of the second comparator 21 is coupled to a second reference voltage terminal (for inputting a second reference voltage $V_{ref-H}$), a second input terminal of the second comparator 21 is coupled to the output voltage terminal, and an output terminal of the second comparator 21 is coupled to a first input terminal of the exclusive-NOR gate 23; a first input terminal of the third comparator 22 is coupled to a third reference voltage terminal (for inputting a third reference voltage $V_{ref-L}$), a second input terminal of the third comparator 22 is coupled to the output voltage terminal, and an output terminal of the third comparator 22 is coupled to a second input terminal of the exclusive-NOR gate 23; an output terminal of the exclusive-NOR gate 23 is coupled with an input terminal of the NOT gate 24 and controls the first switch S1; an output of the NOT gate 24 is configured to control the second switch S2; a second terminal of the first switch S1 is coupled to a first terminal of the first transistor array 4; a second terminal of the second switch S2 is coupled to a first terminal of the second transistor array 5; a second terminal of the first transistor array 4 and a second terminal of the second transistor array 5 are both coupled to the output voltage terminal. Certainly, it should be understood that the digital voltage regulator also includes circuits such as a filter capacitor C and a load resistor R; first terminals of the filter capacitor C and the load resistor R are both coupled to the output voltage terminal, and second terminals of the filter capacitor C and the load resistor R may be grounded.

Taking the third reference voltage $V_{ref-L}$ being less than the first reference voltage $V_{ref}$ and the first reference voltage $V_{ref}$ being less than the second reference voltage $V_{ref-H}$ as an example, the method of regulating voltage by the digital voltage regulator in the embodiment of the present disclosure is described with reference to FIG. 8.

In following descriptions, the difference between the output voltage $V_{out}$ and the first reference voltage $V_{ref}$ is considered to be relative large in response to that the output voltage $V_{out}$ is less than the third reference voltage $V_{ref-L}$ or the output voltage $V_{out}$ is larger than the second reference voltage $V_{ref-H}$; in response to that the output voltage $V_{out}$ is larger than the third reference voltage $V_{ref-L}$ and less than the first reference voltage $V_{ref}$, or the output voltage $V_{out}$ is less than the second reference voltage $V_{ref-H}$ and larger than the first reference voltage $V_{ref}$, the difference between the output voltage $V_{out}$ and the first reference voltage $V_{ref}$ is considered to be relative small. Certainly, a determination of a magnitude of difference between the output voltage $V_{out}$ and the first reference voltage $V_{ref}$ is not limited to foregoing conditions, and for a specific digital voltage regulator, the determination may be performed by comparing the difference between the output voltage $V_{out}$ and the first reference voltage $V_{ref}$ with a certain preset value.

In response to that the output voltage $V_{out}$ output by the output voltage terminal of the digital voltage regulator is less than the third reference voltage $V_{ref-L}$ input by the third reference voltage terminal, it indicates that the output voltage $V_{out}$ is also less than the first reference voltage $V_{ref}$ input by the first reference voltage terminal and the second reference voltage $V_{ref-H}$ input by the second reference voltage terminal, and the difference between the output voltage $V_{out}$ and the first reference voltage $V_{ref}$ is relative large; the output terminal of the second comparator 21 outputs 0, the output terminal of the third comparator 22 also outputs 0, the output terminal of the exclusive-NOR gate 23 outputs 1, the first switch S1 is turned on, the NOT gate 24 outputs 0, the second switch S2 is turned off, and the second terminal of the shift register 33 is electrically coupled to the first terminal of the first transistor array 4 through the first switch S1. Meanwhile, since the output voltage $V_{out}$ is less than the first reference voltage $V_{ref}$, the output terminal of the first comparator 1 outputs a first comparison signal being 0, and the shift register 33 shifts right under control of the clock signal input from the clock signal terminal, so as to control the number of transistors to be turned on in the first transistor array 4 to be increased at a relative high frequency, so that the output voltage $V_{out}$ increases rapidly to approach the first reference voltage $V_{ref}$.

In response to that the output voltage $V_{out}$ output by the output voltage terminal is larger than the third reference voltage $V_{ref-L}$ input by the third reference voltage terminal and less than the first reference voltage $V_{ref}$ input by the first reference voltage terminal, it indicates that the output voltage $V_{out}$ is also less than the second reference voltage $V_{ref-H}$ at the second reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the second terminal of the shift register 33 is electrically coupled with the first terminal of the second transistor array 5 through the second switch S2; meanwhile, since the output voltage $V_{out}$ is less than the first reference voltage $V_{ref}$, the output terminal of the first comparator 1 outputs 0, and the shift register 33 shifts right under control of the clock signal input from the clock signal terminal, and controls the number of transistors to be turned on in the second transistor array 5 to be increased at a relative low frequency, so that the output voltage $V_{out}$ increases finely to approach the first reference voltage $V_{ref}$, and the ripple of the output voltage $V_{out}$ is relative small.

In response to that the output voltage $V_{out}$ output by the output voltage terminal is greater than the first reference voltage $V_{ref}$ input by the first reference voltage terminal and is less than the second reference voltage $V_{ref-H}$ input by the second reference voltage terminal, it indicates that the output voltage $V_{out}$, is greater than the third reference voltage $V_{ref-L}$ input by the third reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the second terminal of the shift register 33 is electrically coupled to the first terminal of the second transistor array 5 through the second switch S2; meanwhile, since the output voltage $V_{out}$ is greater than the first reference voltage $V_{ref}$, the first comparator 1 outputs 1, and the shift register 33 shifts left under control of the second clock signal CLK2 input from the clock signal terminal, so that the number of transistors to be turned on in the second transistor array 5 is controlled at a relative low frequency to be decreased, the output voltage $V_{out}$ decreases finely to approach the first reference voltage $V_{ref}$, and the ripple of the output voltage $V_{out}$ is relative less.

In response to that the output voltage $V_{out}$ output by the output voltage terminal is greater than the second reference voltage $V_{ref-H}$ input by the second reference voltage terminal, it indicates that the output voltage $V_{out}$ is greater than the first reference voltage $V_{ref}$ input by the first reference voltage terminal and the second reference voltage $V_{ref-H}$ input by the second reference voltage terminal, and the difference between the output voltage $V_{out}$ and the first reference voltage $V_{ref}$ is relative large; the output terminal of the second comparator 21 outputs 1, the output terminal of the third comparator 22 also outputs 1, the output terminal of the exclusive-NOR gate 23 outputs 1, the first switch S1 is turned on, the NOT gate 24 outputs 0, the second switch S2 is turned off, and the second terminal of the shift register 33 is electrically coupled to the first terminal of the first transistor array through the first switch S1. Meanwhile, since the output voltage $V_{out}$ is greater than the first reference voltage $V_{ref}$, the first comparator 1 outputs 1, and the shift register 33 shifts left under control of the clock signal input from the clock signal terminal, so as to control the number of transistors to be turned on in the first transistor array 4 to be decreased at a relative high frequency, so that the output voltage $V_{out}$ is rapidly decreased to approach the first reference voltage $V_{ref}$.

In summary, in the digital voltage regulator provided in the embodiment of the present disclosure, in response to that the difference between the output voltage $V_{out}$ and the first reference voltage $V_{ref}$ is relative large, the shift register 33 utilizes the first transistor array 4 with the transistor having the large width-to-length ratio under control of the clock signal to make the output voltage $V_{out}$ approach the first reference voltage $V_{ref}$ quickly; in response to that the difference between the output voltage $V_{out}$ and the first reference voltage $V_{ref}$ is relative small, the shift register 33 utilizes the second transistor array 5 with the transistor having the small width-to-length ratio to make the output voltage $V_{out}$ approach the first reference voltage $V_{ref}$ finely under control of the clock signal, and the ripple of the output voltage $V_{out}$ is relative small.

Figure 7:
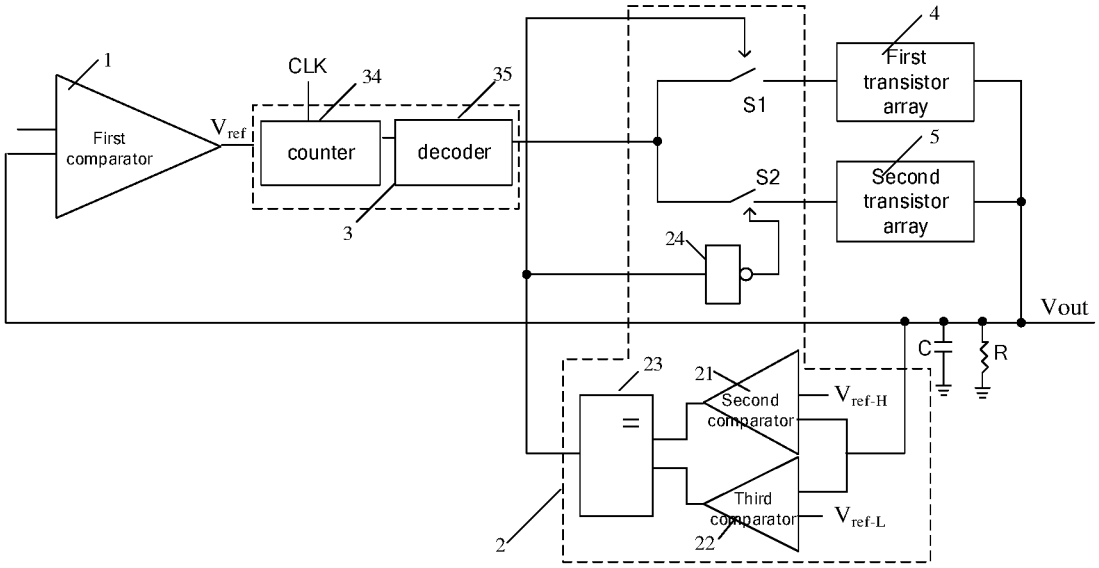
FIG. 7 is a schematic diagram of another digital voltage regulator according to an embodiment of the present disclosure.

As shown in FIG. 7, an embodiment of the present disclosure provides a digital voltage regulator, the structure of the digital voltage regulator is substantially the same as that of the digital voltage regulator shown in FIG. 5, and includes a first comparator 1, a circuit switching circuit 2, a voltage regulation control circuit 3, a first transistor array 4 and a second transistor array 5, where a width-to-length ratio of any one of transistors in the first transistor array 4 is greater than a width-to-length ratio of any one of transistors in the second transistor array 5. The digital voltage regulator of the present embodiment is difference from the voltage regulator shown in FIG. 5 in that: the voltage regulation control circuit 3 includes a counter 34 and a decoder 35.

Specifically, a first terminal of the counter 34 in the voltage regulation control circuit 3 is coupled to the output terminal of the first comparator 1, a second terminal of the counter 34 is coupled to a first terminal of the decoder 35, and a control terminal of the counter 34 is coupled to the clock signal terminal; a second terminal of the decoder 35 is coupled to the circuit switching circuit 2.

The circuit switching circuit 2 in the embodiment of the present disclosure may be the same as the circuit switching circuit 2 shown in FIG. 2, that is, includes a second comparator 21, a third comparator 22, an exclusive-NOE gate 23, a NOT gate 24, a first switch S1 and a second switch S2.

The digital voltage regulator according to the embodiment of the present disclosure will be described with reference to FIG. 7.

Specifically, a first input terminal of the first comparator 1 is coupled to a first reference voltage terminal (for inputting a first reference voltage $V_{ref}$), a second input terminal of the first comparator 1 is coupled to an output voltage terminal (for outputting an output voltage $V_{out}$), an output terminal of the first comparator 1 is coupled to a first terminal of the counter 34, a second terminal of the counter 34 is coupled to a first terminal of the decoder 35, and a control terminal of the counter 34 is coupled to a clock signal terminal (for inputting a clock signal); a second terminal of the decoder 35 is coupled to a first terminal of the first switch S1 and a first terminal of the second switch S2; a first input terminal of the second comparator 21 is coupled to a second reference voltage terminal (for inputting a second reference voltage $V_{ref-H}$), a second input terminal of the second comparator 21 is coupled to the output voltage terminal, and an output terminal of the second comparator 21 is coupled to a first input terminal of the exclusive-NOR gate 23; a first input terminal of the third comparator 22 is coupled to a third reference voltage terminal (for inputting the third reference voltage $V_{ref-L}$), a second input terminal of the third comparator 22 is coupled to the output voltage terminal $V_{out}$, and an output terminal of the third comparator 22 is coupled to a second input terminal of the exclusive-NOR gate 23; an output terminal of the exclusive-NOR gate 23 is coupled with an input terminal of the NOT gate 24 and controls the first switch S1; an output of the NOT gate 24 is configured to control the second switch S2; a second terminal of the first switch S1 is coupled to a first terminal of the first transistor array 4; a second terminal of the second switch S2 is coupled to a first terminal of the second transistor array 5; a second terminal of the first transistor array 4 and a second terminal of the second transistor array 5 are both coupled to the output voltage terminal $V_{out}$. Certainly, it should be understood that the digital voltage regulator also includes circuits such as a filter capacitor C and a load resistor R; first terminals of the filter capacitor C and the load resistor R are both coupled to the output voltage terminal $V_{out}$, and second terminals of the filter capacitor C and the load resistor R may be grounded.

Taking the third reference voltage $V_{ref-L}$ being less than the first reference voltage $V_{ref}$ and the first reference voltage $V_{ref}$ being less than the second reference voltage $V_{ref-H}$ as an example, the method of regulating voltage by the digital voltage regulator in the embodiment of the present disclosure is described with reference to FIG. 8.

In following descriptions, the difference between the output voltage $V_{out}$ and the first reference voltage $V_{ref}$ is considered to be relative large in response to that the output voltage $V_{out}$ is less than the third reference voltage $V_{ref-L}$ or the output voltage $V_{out}$ is larger than the second reference voltage $V_{ref-H}$; in response to that the output voltage $V_{out}$ is larger than the third reference voltage $V_{ref-L}$ and less than the first reference voltage $V_{ref}$, or the output voltage $V_{out}$ is less than the second reference voltage $V_{ref-H}$ and larger than the first reference voltage $V_{ref}$, the difference between the output voltage $V_{out}$ and the first reference voltage $V_{ref}$ is considered to be relative small. Certainly, a determination of a magnitude of difference between the output voltage $V_{out}$ and the first reference voltage $V_{ref}$ is not limited to foregoing conditions, and for a specific digital voltage regulator, the determination may be performed by comparing the difference between the output voltage $V_{out}$ and the first reference voltage $V_{ref}$ with a certain preset value.

In response to that the output voltage $V_{out}$ output by the output voltage terminal of the digital voltage regulator is less than the third reference voltage $V_{ref-L}$ input by the third reference voltage terminal, it indicates that the output voltage $V_{out}$ is also less than the first reference voltage $V_{ref}$ input by the first reference voltage terminal and the second reference voltage $V_{ref-H}$ input by the second reference voltage terminal, and the difference between the output voltage $V_{out}$ and the first reference voltage $V_{ref}$ is relative large; the output terminal of the second comparator 21 outputs 0, the output terminal of the third comparator 22 also outputs 0, the output terminal of the exclusive-NOR gate 23 outputs 1, the first switch S1 is turned on, the NOT gate 24 outputs 0, the second switch S2 is turned off, and the second terminal of the decoder 35 is electrically coupled to the first terminal of the first transistor array 4 through the first switch S1. Meanwhile, since the output voltage $V_{out}$ is less than the first reference voltage $V_{ref}$, the output terminal of the first comparator 1 outputs 0, the counter 34 increases in value under control of the clock signal input from the clock signal terminal and outputs an increased value to the decoder 35, and the decoder 35 controls the number of transistors to be turned on in the first transistor array 4 to be increased according to the increased value, so that the output voltage $V_{out}$ increases rapidly to approach the first reference voltage $V_{ref}$.

Here, since an initial value of the output voltage is 0V, the initial value of the counter 34 is 0. The counter 34 may be chosen to be binary, hexadecimal, or the like, which depends on the specific structure of the digital voltage regulator.

In response to that the output voltage $V_{out}$ output by the output voltage terminal is greater than the third reference voltage $V_{ref\text{-}L}$ input by the third reference voltage terminal and is less than the first reference voltage $V_{ref}$ input by the first reference voltage terminal, it indicates that the output voltage $V_{out}$ is also less than the second reference voltage $V_{ref\text{-}H}$ of the second reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the second terminal of the decoder 35 is electrically coupled with the first terminal of the second transistor array 5 through the second switch S2; meanwhile, since the output voltage $V_{out}$ is less than the first reference voltage $V_{ref}$, the output terminal of the first comparator 1 outputs 0, the counter 34 increases in value under control of the clock signal input from the clock signal terminal, and outputs the increased value to the decoder 35, and the decoder 35 controls the number of transistors to be turned on in the second transistor array 5 to be increased according to the increased value, so that the output voltage $V_{out}$ increases finely to approach the first reference voltage $V_{ref}$, and the ripple of the output voltage $V_{out}$ is relative small.

In response to that the output voltage $V_{out}$ output by the output voltage terminal is greater than the first reference voltage $V_{ref}$ input by the first reference voltage terminal and is less than the second reference voltage $V_{ref\text{-}H}$ input by the second reference voltage terminal, it indicates that the output voltage $V_{out}$ is greater than the third reference voltage $V_{ref\text{-}L}$ input by the third reference voltage terminal, and the difference between the output voltage $V_{out}$ and the first reference voltage $V_{ref}$ is relative small; the output terminal of the second comparator 21 outputs 0, the output terminal of the third comparator 22 outputs 1, the output terminal of the exclusive-NOR gate 23 outputs 0, the first switch S1 is turned off, the NOT gate 24 outputs 1, the second switch S2 is turned on, and the second terminal of the decoder 35 is electrically coupled to the first terminal of the second transistor array 5 through the second switch S2; meanwhile, since the output voltage $V_{out}$ is greater than the first reference voltage $V_{ref}$, the output terminal of the first comparator 1 outputs 1, the counter 34 decreases in value under control of the clock signal input by the clock signal terminal, and outputs the decreased value to the decoder 35, and the decoder 35 controls the number of transistors to be turned on in the second transistor array 5 to be decreased according to the decreased value, so that the output voltage $V_{out}$ decreases finely to approach the first reference voltage $V_{ref}$, and the ripple of the output voltage $V_{out}$ is relative small.

In response to that the output voltage $V_{out}$ output by the output voltage terminal is greater than the second reference voltage $V_{ref\text{-}H}$ input by the second reference voltage terminal, it indicates that the output voltage $V_{out}$ is greater than the first reference voltage $V_{ref}$ input by the first reference voltage terminal and the second reference voltage $V_{ref\text{-}H}$ input by the second reference voltage terminal, and the difference between the output voltage $V_{out}$ and the first reference voltage $V_{ref}$ is relative large; the output terminal of the second comparator 21 outputs 1, the output terminal of the third comparator 22 also outputs 1, the output terminal of the exclusive-NOR gate 23 outputs 1, the first switch S1 is turned on, the NOT gate 24 outputs 0, the second switch S2 is turned off, and the second terminal of the decoder 35 is electrically coupled to the first terminal of the first transistor array through the first switch S1. Meanwhile, since the output voltage $V_{out}$ is greater than the first reference voltage $V_{ref}$, the first comparator 1 outputs 1, the counter 34 decreases in value under control of the clock signal input from the clock signal terminal, and outputs a decreased value to the decoder 35, and the decoder 35 controls the number of transistors to be turned on in the first transistor array 4 to be decreased according to the value, so that the output voltage $V_{out}$ decreases rapidly to approach the first reference voltage $V_{ref}$.

In summary, in the digital voltage regulator provided in the embodiment of the present disclosure, in response to that the difference between the output voltage $V_{out}$ and the first reference voltage $V_{ref}$ is relative large, the counter 34 increases or decreases in value under control of the clock signal, and then the decoder 35 controls the first transistor array 4 with the transistor having the large width-to-length ratio to make the output voltage $V_{out}$ approach the first reference voltage $V_{ref}$ quickly; in response to that the difference between the output voltage $V_{out}$ and the first reference voltage $V_{ref}$ is relative small, the counter 34 increases or decreases in value under control of the clock signal, and then the decoder 35 controls the second transistor array 5 with the transistor having the small width-to-length ratio to make the output voltage $V_{out}$ approach the first reference voltage $V_{ref}$ finely, and the ripple of the output voltage Vout is relative small.

Figure 8:
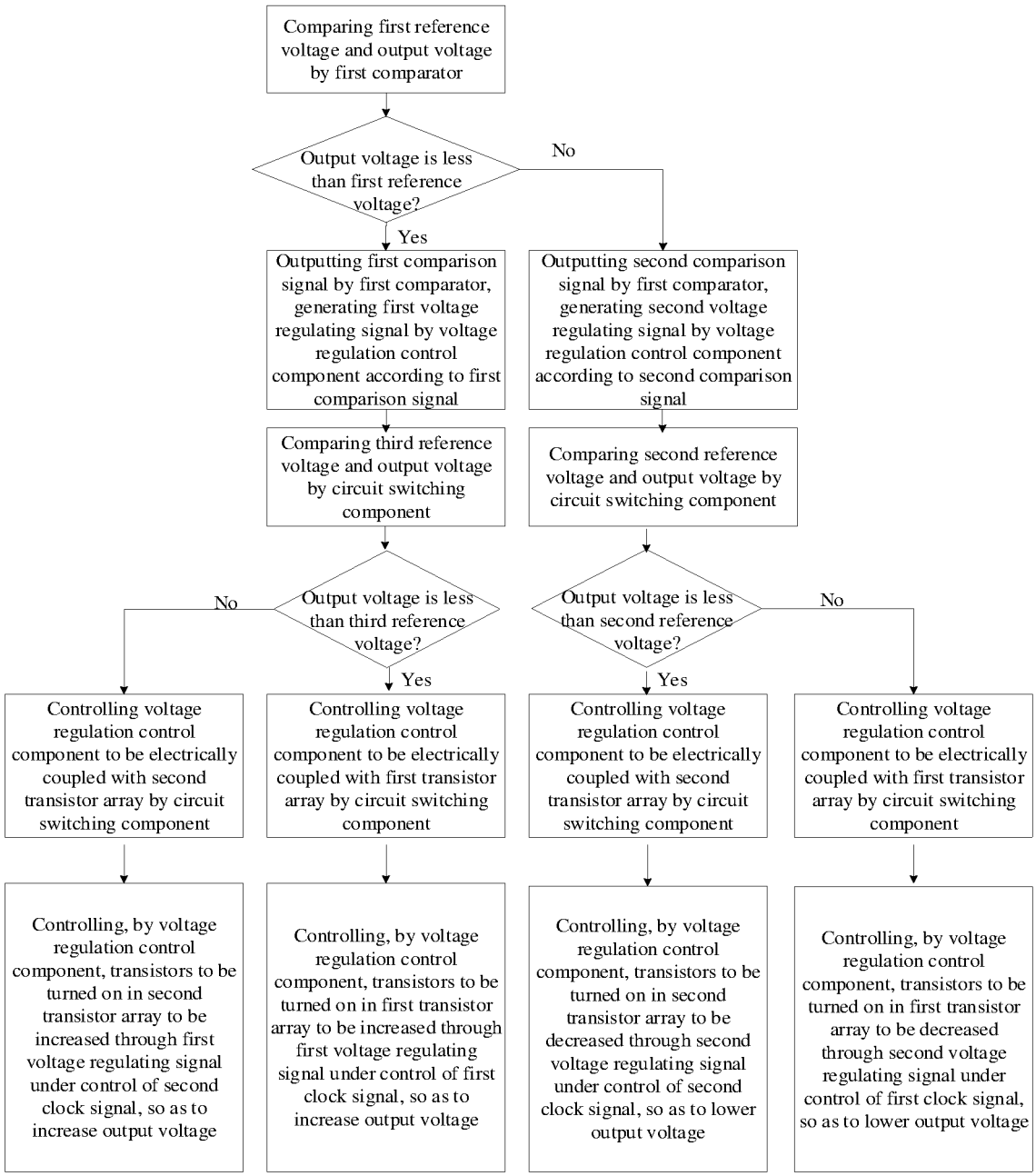
FIG. 8 is a flow chart illustrating a method of regulating voltage by a digital voltage regulator according to an embodiment of the present disclosure.

As shown in FIG. 8, the present disclosure provides a method of regulating voltage by a digital voltage regulator, which may be applied to the digital voltage regulator in foregoing embodiments. The specific steps of the method may be referred to the specific description of the digital voltage regulator in the above embodiments in conjunction with FIGS. 1 to 7.

It is to be understood that the above embodiments are merely exemplary embodiments adopted to illustrate the principle of the present disclosure, and the present disclosure is not limited thereto. It will be apparent to those skilled in the art that various changes and modifications may be made without departing from the spirit of the present disclosure, and these changes and modifications are also considered to fall within the scope of the present disclosure.

The invention claimed is:

1. A digital voltage regulator, comprising a first comparator, a circuit switching circuit, a voltage regulation control circuit, a first transistor array and a second transistor array, wherein a width-to-length ratio of any one of transistors in the first transistor array is larger than a width-to-length ratio of any one of transistors in the second transistor array, and wherein, the first comparator is configured to output a comparison result between a first reference voltage and an output voltage;

the voltage regulation control circuit is configured to generate a voltage regulating signal according to the comparison result output by the first comparator under control of a clock signal; and the circuit switching circuit is configured to select, according to a comparison result between the output voltage and a second reference voltage and a comparison result between the output voltage and a third reference voltage, one of the first transistor array and the second transistor array to regulate the output voltage based on the voltage regulating signal, wherein the voltage regulation control circuit comprises a first voltage regulation control circuit and a second voltage regulation control circuit, wherein, the first voltage regulation control circuit is coupled between the circuit switching circuit and the first transistor array, and is configured to, in response to that the first voltage regulation control circuit is electrically coupled with the first comparator under control of the circuit switching circuit, generate a first voltage regulating signal according to the comparison result output by the first comparator under control of a first clock signal, so as to control a number of transistors to be turned on in the first transistor array; and the second voltage regulation control circuit is coupled between the circuit switching circuit and the second transistor array, and is configured to, in response to that the second voltage regulation control circuit is electrically coupled with the first comparator under control of the circuit switching circuit, generate a second voltage regulating signal according to the comparison result output by the first comparator under control of a second clock signal, so as to control a number of transistors to be turned on in the second transistor array.

2. The digital voltage regulator of claim 1, wherein the first voltage regulation control circuit comprises a first shift register, and a first terminal of the first shift register is coupled with the circuit switching circuit, a second terminal of the first shift register is coupled with the first transistor array, and a control terminal of the first shift register is coupled with a first clock signal terminal; and the second voltage regulation control circuit comprises a second shift register, and a first terminal of the second shift register is coupled with the circuit switching circuit, a second terminal of the second shift register is coupled with the second transistor array, and a control terminal of the second shift register is coupled with a second clock signal terminal.

3. The digital voltage regulator of claim 1, wherein the first voltage regulation control circuit comprises a first counter and a first decoder, a first terminal of the first counter is coupled with the circuit switching circuit, a second terminal of the first counter is coupled with a first terminal of the first decoder, a control terminal of the first counter is coupled with the first clock signal terminal, and a second terminal of the first decoder is coupled with the first transistor array; and the second voltage regulation control circuit comprises a second counter and a second decoder, a first terminal of the second counter is coupled with the circuit switching circuit, a second terminal of the second counter is coupled with a first terminal of the second decoder, a control terminal of the second counter is coupled with the second clock signal terminal, and a second terminal of the second decoder is coupled with the second transistor array.

4. The digital voltage regulator of claim 1, wherein the circuit switching circuit comprises a second comparator, a third comparator, an exclusive-NOR gate, a NOT gate, a first switch and a second switch, wherein, a first input terminal of the second comparator is coupled with a second reference voltage terminal, a second input terminal of the second comparator is coupled with an output voltage terminal, and an output terminal of the second comparator is coupled with a first input terminal of the exclusive-NOR gate;

a first input terminal of the third comparator is coupled with a third reference voltage terminal, a second input terminal of the third comparator is coupled with the output voltage terminal, and an output terminal of the third comparator is coupled with a second input terminal of the exclusive-NOR gate;

an output terminal of the exclusive-NOR gate is coupled with an input terminal of the NOT gate, and an output of the exclusive-NOR gate is configured to control the first switch;

an output of the NOT gate is configured to control the second switch;

a first terminal of the first switch is coupled with the output terminal of the first comparator, and a second terminal of the first switch is coupled with the first voltage regulation control circuit; and a first terminal of the second switch is coupled with the output terminal of the first comparator, and a second terminal of the second switch is coupled with the second voltage regulation control circuit.

5. A digital voltage regulator, comprising a first comparator, a circuit switching circuit, a voltage regulation control circuit, a first transistor array and a second transistor array, wherein a width-to-length ratio of any one of transistors in the first transistor array is larger than a width-to-length ratio of any one of transistors in the second transistor array, and wherein, the first comparator is configured to output a comparison result between a first reference voltage and an output voltage;

the voltage regulation control circuit is configured to generate a voltage regulating signal according to the comparison result output by the first comparator under control of a clock signal; and the circuit switching circuit is configured to select, according to a comparison result between the output voltage and a second reference voltage and a comparison result between the output voltage and a third reference voltage, one of the first transistor array and the second transistor array to regulate the output voltage based on the voltage regulating signal, wherein a first terminal of the voltage regulation control circuit is coupled to the first comparator, a second terminal of the voltage regulation control circuit is coupled to the circuit switching circuit, and a control terminal of the voltage regulation control circuit is coupled to a clock signal terminal, and wherein the circuit switching circuit comprises a second comparator, a third comparator, an exclusive-NOR gate, a NOT gate, a first switch and a second switch, wherein, a first input terminal of the second comparator is coupled with a second reference voltage terminal, a second input terminal of the second comparator is coupled with an output voltage terminal, and an output terminal of the second comparator is coupled with a first input terminal of the exclusive-NOR gate;

a first input terminal of the third comparator is coupled with a third reference voltage terminal, a second input terminal of the third comparator is coupled with the output voltage terminal, and an output terminal of the third comparator is coupled with a second input terminal of the exclusive-NOR gate;

an output terminal of the exclusive-NOR gate is coupled with an input terminal of the NOT gate and is configured to control the first switch;

an output terminal of the NOT gate is configured to control the second switch;

a first terminal of the first switch is coupled with the second terminal of the voltage regulation control circuit, and a second terminal of the first switch is coupled with the first transistor array; and a first terminal of the second switch is coupled with the second terminal of the voltage regulation control circuit, and a second terminal of the second switch is coupled with the second transistor array.

6. The digital voltage regulator of claim 5, wherein the voltage regulation control circuit comprises a shift register, wherein, a first terminal of the shift register is coupled with the first comparator, a second terminal of the shift register is coupled with the circuit switching circuit, and a control terminal of the shift register is coupled with the clock signal terminal.

7. The digital voltage regulator of claim 5, wherein the voltage regulation control circuit comprises a counter and a decoder, wherein, a first terminal of the counter is coupled with the output terminal of the first comparator, a second terminal of the counter is coupled with a first terminal of the decoder, a control terminal of the counter is coupled with the clock signal terminal, and a second terminal of the decoder is coupled with the circuit switching circuit.

8. The digital voltage regulator of claim 1, wherein a first input terminal of the first comparator is coupled to a first reference voltage terminal, a second input terminal of the first comparator is coupled to an output voltage terminal, and an output terminal of the first comparator is coupled to the circuit switching circuit.

9. The digital voltage regulator of claim 4, wherein a first terminal of a filter capacitor and a first terminal of a load resistor are coupled between each of second input terminals, of the second comparator and the third comparator, and the output voltage terminal, and a second terminal of the filter capacitor and a second terminal of the load resistor are both grounded.

10. The digital voltage regulator of claim 1, wherein the first reference voltage is greater than the third reference voltage and less than the second reference voltage.

11. The digital voltage regulator of claim 2, wherein the first clock signal terminal outputs the first clock signal, the second clock signal terminal outputs the second clock signal, and wherein a frequency of the first clock signal is greater than a frequency of the second clock signal.

12. The digital voltage regulator of claim 5, wherein the clock signal terminal outputs the first clock signal or the second clock signal, and wherein a frequency of the first clock signal is greater than a frequency of the second clock signal.

13. A method of regulating voltage by the digital voltage regulator according to claim 1, comprising:

outputting, by a first comparator, a comparison result between a first reference voltage and an output voltage, and generating, by a voltage regulation control circuit, a voltage regulating signal according to the comparison result output by the first comparator under control of a clock signal; and controlling, by a circuit switching circuit, one of the first transistor array and the second transistor array according to a comparison result between the output voltage and a second reference voltage and a comparison result between the output voltage and a third reference voltage to regulate the output voltage based on the voltage regulating signal.

14. The method of claim 13, wherein the first reference voltage is greater than the third reference voltage and less than the second reference voltage, and the clock signal comprises a first clock signal and a second clock signal, and a frequency of the first clock signal is greater than a frequency of the second clock signal.

15. The method of claim 14, wherein outputting, by the first comparator, a comparison result between a first reference voltage and an output voltage, and generating, by the voltage regulation control circuit, a voltage regulating signal according to the comparison result output by the first comparator under control of a clock signal comprises:

comparing, by the first comparator, the output voltage with the first reference voltage, outputting, by the first comparator, a first comparison signal in response to that the output voltage is less than the first reference voltage, and generating, by the voltage regulation control circuit, a first voltage regulating signal according to the first comparison signal, and wherein controlling, by the circuit switching circuit, one of the first transistor array and the second transistor array to regulate the output voltage according to a comparison result between the output voltage and a second reference voltage and a comparison result between the output voltage and a third reference voltage comprises:

comparing, by the circuit switching circuit, the output voltage with the third reference voltage, and in response to that the output voltage is less than the third reference voltage, controlling, by the circuit switching circuit, the voltage regulation control circuit to be electrically coupled with the first transistor array, and controlling, by the voltage regulation control circuit, the number of transistors to be turned on in the first transistor array to be increased according to the first voltage regulating signal under control of the first clock signal, so as to increase the output voltage; or in response to that the output voltage is greater than the third reference voltage, controlling, by the circuit switching circuit, the voltage regulation control circuit to be electrically coupled with second transistor array, and controlling, by the voltage regulation control circuit, the number of transistors to be turned on in the second transistor array to be increased according to the first voltage regulating signal under control of the second clock signal, so as to increase the output voltage.

16. The method of claim 14, wherein outputting, by the first comparator, a comparison result between a first reference voltage and an output voltage, and generating, by the voltage regulation control circuit, a voltage regulating signal according to the comparison result output by the first comparator under control of a clock signal comprises:

comparing, by the first comparator, the output voltage with the first reference voltage, outputting, by the first comparator, a second comparison signal in response to that the output voltage is greater than the first reference voltage, and generating, by the voltage regulation control circuit, a second voltage regulating signal according to the second comparison signal, and wherein controlling, by the circuit switching circuit, one of the first transistor array and the second transistor array to regulate the output voltage according to a comparison result between the output voltage and a second reference voltage and a comparison result between the output voltage and a third reference voltage comprises:

comparing, by the circuit switching circuit, the output voltage and the second reference voltage, and in response to that the output voltage is greater than the second reference voltage, controlling, by the circuit switching circuit, the voltage regulation control circuit to be electrically coupled with the first transistor array, and controlling, by the voltage regulation control circuit, the number of transistors to be turned on in the first transistor array to be decreased according to the second voltage regulating signal under control of the first clock signal, so as to decrease the output voltage; or in response to that the output voltage is less than the second reference voltage, controlling, by the circuit switching circuit, the voltage regulation control circuit to be electrically coupled with the second transistor array, and controlling, by the voltage regulation control circuit, the number of transistors to be turned on in the second transistor array to be decreased according to the second voltage regulating signal under control of the second clock signal, so as to decrease the output voltage.

17. The digital voltage regulator of claim 5, wherein the first reference voltage is greater than the third reference voltage and less than the second reference voltage.

18. The digital voltage regulator of claim 3, wherein the first clock signal terminal outputs the first clock signal, the second clock signal terminal outputs the second clock signal, and wherein a frequency of the first clock signal is greater than a frequency of the second clock signal.

* * * * *